US011719508B2

(12) United States Patent
Dewalch

(10) Patent No.: US 11,719,508 B2
(45) **Date of Patent: *Aug. 8, 2023**

(54) ROTATABLE FIREARM BOLT ASSEMBLY AND FIREARMS INCLUDING THE SAME

(71) Applicant: DEWALCH FM, LLC, Houston, TX (US)

(72) Inventor: Norman Binz Dewalch, Houston, TX (US)

(73) Assignee: DeWalch FM LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/343,916

(22) Filed: Jun. 10, 2021

(65) Prior Publication Data

US 2022/0049927 A1 Feb. 17, 2022

Related U.S. Application Data

(63) Continuation of application No. 16/279,211, filed on Feb. 19, 2019, now Pat. No. 11,143,488.

(51) Int. Cl.

| | |
|---|---|
| ***F41F 1/10*** | (2006.01) |
| ***F41A 9/36*** | (2006.01) |
| ***F41A 3/26*** | (2006.01) |
| ***F41A 7/08*** | (2006.01) |

(52) U.S. Cl.

CPC ..... *F41F 1/10* (2013.01); *F41A 3/26* (2013.01); *F41A 7/08* (2013.01); *F41A 9/36* (2013.01)

(58) Field of Classification Search

CPC ..... F41F 1/10; F41A 9/36; F41A 3/26; F41A 3/60; F41A 7/08; F41A 19/30

USPC ..... 89/12, 127, 13.05; 42/16

See application file for complete search history.

(56) References Cited

U.S. PATENT DOCUMENTS

| | | | | |
|---|---|---|---|---|
| 3,595,128 A * | 7/1971 | Hoyt, Jr. | F41F 1/10 | 89/27.11 |
| 3,611,866 A * | 10/1971 | Jacolucci | F41F 1/10 | 89/185 |
| 3,766,821 A * | 10/1973 | Cozzy | F41F 1/10 | 89/149 |
| 3,996,684 A * | 12/1976 | Bauman | F41A 3/26 | 89/185 |
| 4,141,276 A * | 2/1979 | Taylor | F41A 17/66 | 89/188 |

(Continued)

OTHER PUBLICATIONS

Dillonaero Product, Bold Assembly, downloaded from Internet May 21, 2019., https://dillonaero.com/product/bolt-assembly/, 5 pages.

(Continued)

*Primary Examiner* — Michael D David

(74) *Attorney, Agent, or Firm* — Grossman, Tucker, Perreault & Pfleger, PLLC

(57) ABSTRACT

Firearm bolt assemblies and firearms including the same are described. In embodiments the firearm bolt assemblies are configured to localize compressive forces applied during a transition from an initial position to a firing position to a first cam system on one side of the firearm bolt assembly, and to localize compressive forces applied during a transition from the firing position to the initial position to a second cam system another side of the firearm bolt assembly. Localizing the forces in that manner enables the use of a first cam system that is relatively robust compared to the second cam system.

20 Claims, 15 Drawing Sheets

(56) References Cited

U.S. PATENT DOCUMENTS 4,172,410 A * 10/1979 Reynolds ..... F41A 7/10 89/188
4,274,325 A * 6/1981 Snyder ..... F41F 1/10 89/12
4,301,710 A * 11/1981 Kirkpatrick ..... F41F 1/10 89/12
4,316,403 A * 2/1982 Kirkpatrick ..... F41F 1/10 89/12
4,329,907 A * 5/1982 Kirkpatrick ..... F41F 1/10 89/185
4,494,439 A * 1/1985 Sawyer ..... F41A 19/28 89/33.04
4,563,937 A * 1/1986 White ..... F41A 21/484 89/185
6,742,434 B1 * 6/2004 Dillon ..... F41A 3/26 42/16
7,013,789 B2 * 3/2006 Dillon ..... F41F 1/10 89/12
7,441,490 B2 * 10/2008 Dillon ..... F41A 13/06 89/13.05
7,568,422 B1 * 8/2009 Barrett ..... F41A 3/26 89/190
7,703,374 B1 * 4/2010 Dillon ..... F41A 17/32 89/12
8,356,543 B2 * 1/2013 Rosol ..... F41A 3/82 89/188
9,587,895 B1 * 3/2017 Abbott ..... F41F 1/10
10,359,245 B2 * 7/2019 Abbott ..... F41A 7/10
2012/0180354 A1 * 7/2012 Sullivan ..... F41A 3/66 42/16
2019/0257604 A1 * 8/2019 Dewalch ..... F41A 9/31

OTHER PUBLICATIONS

Office Action from corresponding U.S. Appl. No. 16/279,211, dated Feb. 20, 2020. 7 pages.
Office Action from corresponding U.S. Appl. No. 16/279,211, dated Jun. 25, 2020. 13 pages.
Final Office Action from corresponding U.S. Appl. No. 16/279,211, dated Dec. 10, 2020. 9 pages.
Notice of Allowance from corresponding U.S. Appl. No. 16/279,211, dated Jun. 14, 2021. 12 pages.

* cited by examiner

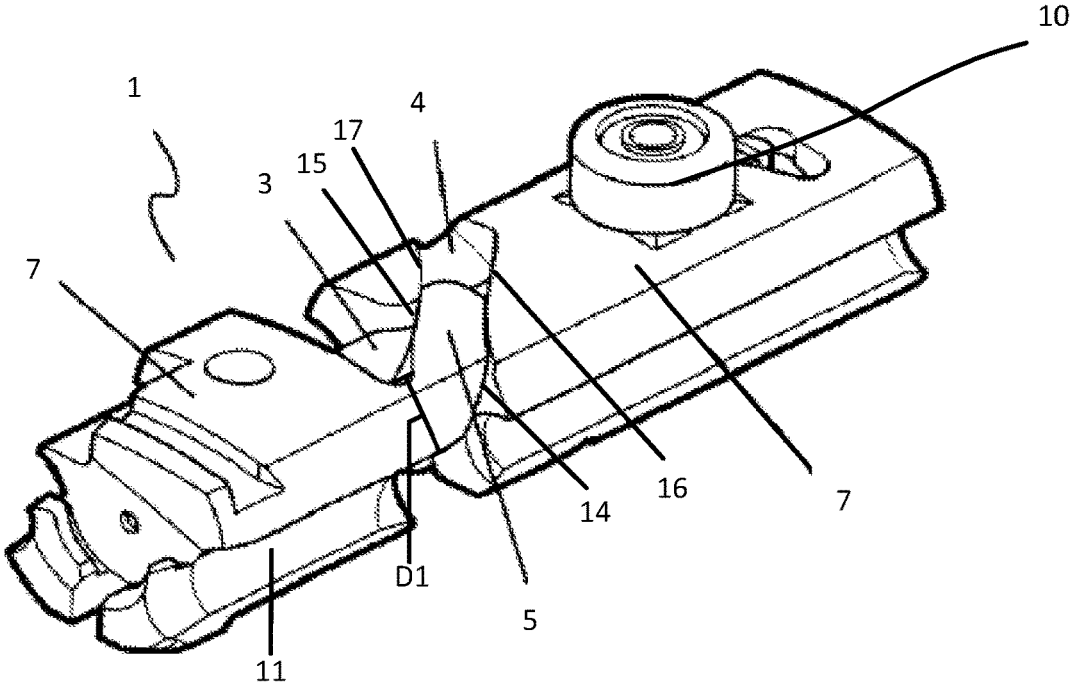
FIG. 1 – PRIOR ART
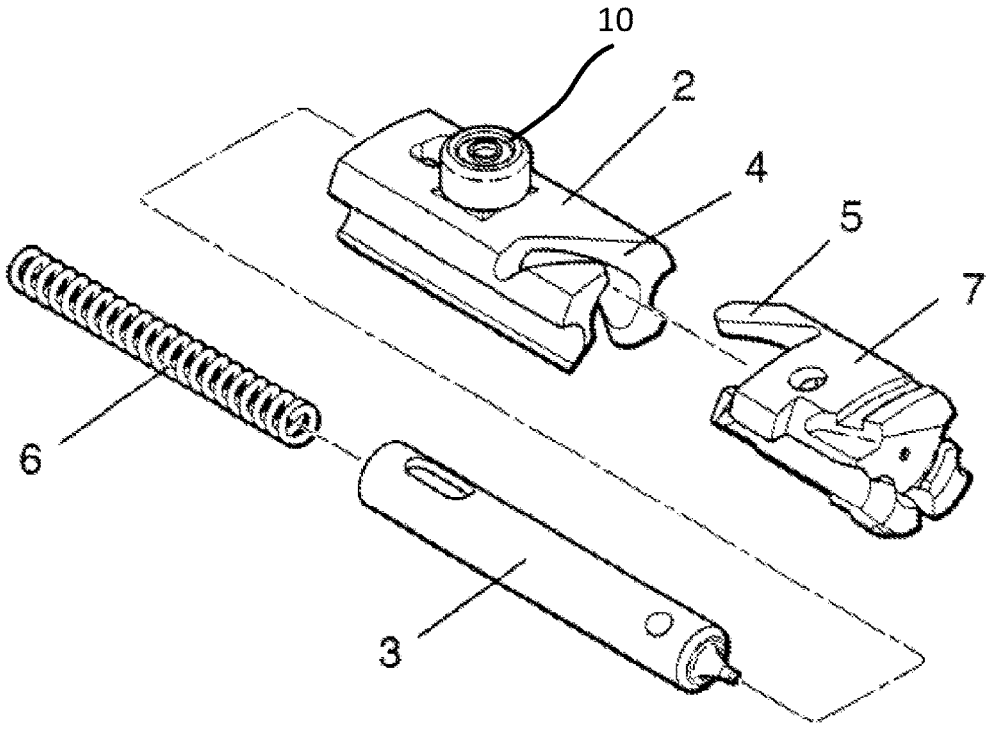
FIG. 2 – PRIOR ART

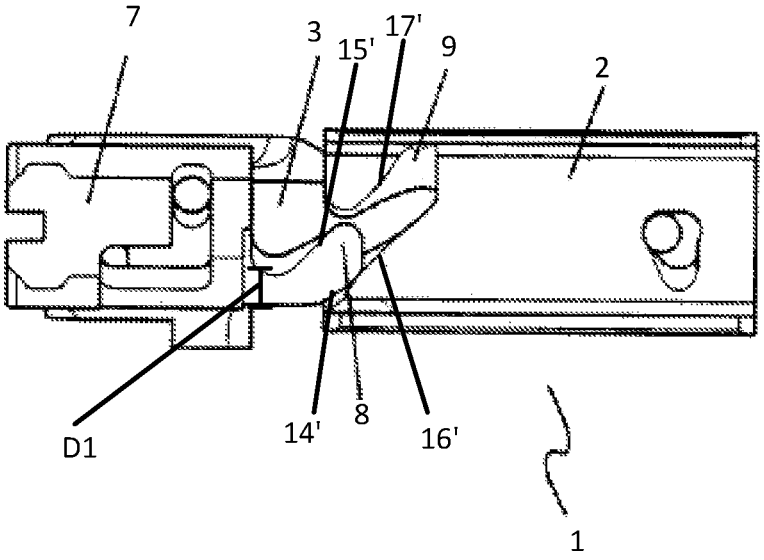
FIG. 3 – PRIOR ART
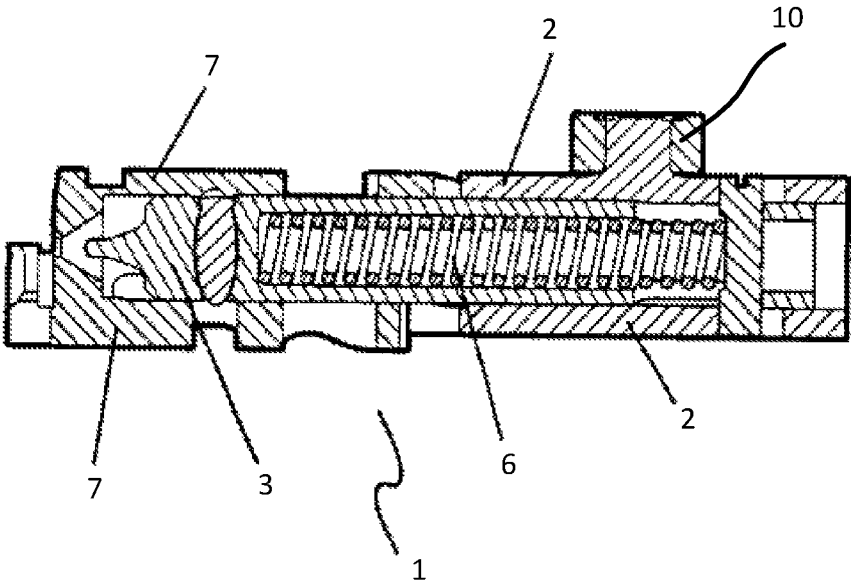
FIG. 4 – PRIOR ART

Top

Bottom

Left Side

Right Side

Front

600

Top Sequence

Bottom Sequence

ROTATABLE FIREARM BOLT ASSEMBLY AND FIREARMS INCLUDING THE SAME

CROSS REFERENCE TO RELATED APPLICATION

This application is a Continuation of U.S. patent application Ser. No. 16/279,211 filed Ser. No. 16/279,211, which is incorporated herein by reference in its entirety.

TECHNICAL FIELD

The present disclosure generally relates to firearm bolts and, more particularly, to rotatable firearm bolts. Firearms including such bolts are also described.

BACKGROUND

The "Gatling gun" is a firearm that was originally developed in the mid-nineteenth century. In general, the Gatling gun is a multiple barrel firearm that includes a plurality of barrels (e.g., six). In operation, the Gatling gun fires projectiles in an automatic fashion as the plurality of barrels rotate in a circuit about an axis. As they rotate the barrels consecutively move to a single firing position that allows for the firing of a projectile. After a projectile is fired from one barrel, that barrel continues to rotate, bringing the next barrel to the firing position. Thus, each of the barrels fires only a portion of the projectiles that are shot by the firearm. Over time many improvements have been made to the original Gatling gun, advancing the design of the gun from a crank driven design to the design used in the modern M-134 "minigun." Despite many improvements made over the years, the M-134 has retained the multiple rotating barrel design that is a hallmark of this type of firearm.

Like many firearms the M-134 utilizes cartridge ammunition. Cartridge ammunition generally includes a projectile (e.g., a bullet) that is mounted over an explosive charge. The bullet and charge are held together by a casing that includes an explosive primer. In many modern firearms the primer is designed to ignite in response to a force imparted from a firing pin, which may reside within a firearm bolt. Ignition of the primer is transferred to the charge, causing the charge to detonate and launch the bullet (e.g., through a barrel). In some cases, the bolt is also designed to eject spent cartridges from the firearm and chamber the next cartridge.

In firearms that include multiple rotating barrels such as the M-134, each barrel is typically associated with its own bolt. Such bolts often include a head and a body that is movable relative to the head. Common bolt designs that are used in the M-134 include the bolt described in U.S. Pat. No. 3,611,866 (hereinafter, the "GE bolt") and the bolt described in U.S. Pat. No. 6,742,434 (hereinafter, the "Dillon bolt"). The structure and operation of the GE bolt and the Dillon bolt are described in detail in the '866 and '434 patents, the entire content of both of which are incorporated herein by reference. Since the operation of such bolts is essentially the same, a summary description of the construction and operation of only the Dillon bolt is provided herein in the interest of brevity.

FIGS. 1-4 depict various views of a Dillon bolt assembly 1 as described in the '434 patent. As shown, the Dillon bolt assembly 1 includes a bolt body 2 and a bolt head 7. A firing pin 3 including a firing pin spring 6 is disposed within a cavity of the bolt body 2 and the bolt head 7. The firing pin 3 is spring biased by the firing pin spring 6, which is coupled to the bolt head 7 by a release pin that moves within an L-shaped slot (shown in FIG. 3 but not labeled). The bolt body 2 and bolt head 7 are mechanically coupled to one another via first and second cam assemblies that are positioned on opposite sides of the bolt body 2 and bolt head 7.

In the Dillon bolt, the first and second cam assemblies are substantially identical but are located on opposite sides of the bolt. Each of the first and second cam assemblies is defined by a female helical cam slot formed in the bolt body 2 and a male helical cam arm formed by part of the bolt head 7. The first helical cam assembly is shown in FIG. 1 and includes a first female helical cam slot 4 and first helical cam arm 5, both of which are formed proximate the top of the bolt assembly. The second helical cam assembly is shown in FIG. 3 and includes a second male helical cam arm 8 and second female helical cam slot 9, both of which are formed proximate the bottom of the bolt assembly. As shown, the first and second male helical cam arms 5, 8 are configured to fit and slide within the first and second female helical cam slots 4, 9, respectively.

The first male helical cam arm 5 includes helical cam surfaces 14, 15, which interact with (e.g., slide against) corresponding helical cam surfaces 16, 17 of the first female helical cam slot 4, as shown in FIG. 1. The second male helical cam arm 8 includes first and second helical cam surfaces 14', 15', which interact with (e.g., slide against) corresponding helical cam surfaces 16', 17' of the second female helical cam slot 9, as shown in FIG. 3. Interaction of the helical cam surfaces of the male helical cam arms and female helical cam slots cause the bolt head 7 to twist/rotate relative to the bolt body 2 as the bolt body 2 is compressed and retracted relative to the bolt head 7.

In operation, six Dillon bolts are mounted to a respective one of six tracks in a rotor of a receiver of an M-134 via track slots 11 formed on either side of the bolt. Each track (and thus, each Dillon bolt) is associated with one of six rotating barrels of the firearm. To fire the M-134, each of the six barrels is rotated by a rotor in concert with its corresponding bolt. The bolts rotate and move towards and away from their respective barrel by the movement of a cam roller 10 within a helical path formed on the inside of the casing of the receiver. As the cam roller 10 travels along the helical path, the bolt acquires an ammunition cartridge (e.g., from an ammunition feeder such as a de-linker) and chambers the cartridge. Eventually the proximal end (not labeled) of the bolt head 7 abuts its corresponding barrel, such that the bolt head 7 and bolt body 2 are in an initial (pre-firing) position, but the helical path continues forward. As the cam roller 10 continues to move forward along the helical path, the bolt body 2 is compressed against the bolt head 7. This causes a compressive force to be exerted by the helical cam surfaces 16, 16' of the female helical cam slots 4, 9 against the helical cam surfaces 14, 14' of the male helical cam arms 5, 8. That compressive force causes the helical cam surfaces 16, 16' of the first and second female cam slots 4, 9 to interact with the helical cam surfaces 14, 14' of the male helical cam arms 5, 8. Such interaction causes the bolt head 7 to twist in a first direction relative to the bolt body 2 while simultaneously compressing the firing pin spring 6 and cocking the firing pin 3.

When the cam roller 10 reaches the forward most position of the helical path (i.e., the bolt assembly 1 is in the "firing position") the firing pin spring 6 is released, causing the firing pin 3 to strike the primer of a cartridge that is chambered in the bolt. As noted above, the firing pin 3 is also coupled to the bolt head 7 by a release pin that moves within an L-shaped slot (shown in FIG. 3 but not labeled) that has a vertical leg and a longitudinal leg. As the bolt head 7 and bolt body 2 are compressed against one another (i.e., when the cam roller 10 is moving along the helical path towards the firing position), the firing pin 3 is biased against the firing pin spring 6 via interaction of the release pin with the vertical leg of the slot. When the cam roller 10 (i.e., the bolt assembly 1) reaches the firing position, the rotational difference between the bolt head 7 and the bolt body 2 causes the release pin to move into the longitudinal leg of the L-shaped slot. This causes the firing pin to release and ignite the primer of a cartridge chambered in the bolt.

Subsequently the cam roller 10 is moved backwards along the helical path. That movement causes a compression force to be exerted by helical cam surfaces 17, 17' of the female came slots 4, 9 against the helical cam surfaces 15, 15' of the male helical cam arms 5, 8. That compressive force causes the helical cam surfaces 17, 17' of the female cam slots 4, 9 to interact with the helical cam surfaces 15, 15' of the male helical cam arms 5, 8—causing the bolt head 2 to twist in a second direction relative to the bolt body 7 as the bolt head 2 is retracted away from the bolt head 7. Ultimately such interaction causes the bolt head 2 to realign with the bolt head 7 and causes the release pin to move back into the vertical leg of the L-shaped slot—resetting the bolt assembly 1 for another firing cycle.

Although it is functionally quite like the Dillon bolt, the GE bolt includes a single cam assembly formed by a single male cam arm on the bolt head and a single female cam slot in the bolt body. One issue with the GE bolt design is that rotation of the bolt head relative to the bolt body is caused by interaction of the single male cam arm and single female cam slot during both compression and retraction of the bolt assembly. As a result, asymmetrical loads are placed on the single cam assembly and, more specifically, at the point at which the male cam arm meets the rest of the cam head (hereinafter, the "neck" of the male cam arm). Over time such loads can fatigue and eventually break the male cam arm, resulting in a bolt failure. The Dillon bolt addressed that problem by utilizing two cam assemblies on opposite sides of the bolt as discussed above. The use of two cam assemblies balanced the load across the bolt assembly during use, resulting in fewer bolt failures than the GE bolt.

While the Dillon bolt did improve upon the GE bolt, as noted above the Dillon bolt utilizes two cam assemblies that each includes two pairs of helical cam surfaces. Specifically, the Dillon bolt includes a first cam assembly that includes a first pair of helical cam surfaces 14, 16 that interact as the bolt assembly is compressed from an initial position to a firing position, and a second pair of helical cam surfaces 15, 17 that interact as the bolt assembly is retracted from the firing position to the initial position. Likewise, the second cam assembly includes a first pair of helical cam surfaces 14', 16' that interact as the bolt assembly is compressed, and a second pair of helical cam surfaces 15', 17' that interact as the bolt assembly is retracted. Both cam assemblies also include a male cam arm that has a relatively thin neck. This is illustrated in FIGS. 1 and 3, in which distance D1 is a surface distance defining the neck of each of the male cam arms 5, 8.

Interaction of surfaces 14, 16 and 14', 16' can impose a significant load on the neck of their respective male cam arm 5, 8 during compression of the bolt assembly 1 (i.e., movement between an initial and firing position). Likewise, interaction of surfaces 15, 17 and 15' 17' can impose a significant load on the neck of their respective male cam arm 5, 8 during retraction of the bolt assembly 1 (i.e., movement between the firing position and initial position). Thus, the neck of each of the male cam arms in the Dillon bolt may be subject to significant loads as the bolt is compressed and retracted during a firing cycle. Over time, such loads can lead to failure of one or both male cam arms 5, 8, potentially leading to failure of the entire bolt assembly. This issue may be exacerbated by the exceptionally high firing rate of rotatable firearms such as the M-134, which may be as high as 4,000-6,000 rounds per minute or more.

Thus, there remains a need in the art for a firearm bolt assembly that reduces or eliminates loads placed on weaker areas of the bolt, while remaining compatible with existing firearm designs such as the M-134.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

FIG. 1 is a top perspective view of a prior art Dillon bolt;

FIG. 2 is an exploded view of the prior art Dillon bolt of FIG. 1;

FIG. 3 is a bottom view of the prior art Dillon bolt of FIG. 1;

FIG. 4 is a cross sectional view of the prior art Dillon bolt of FIG. 1;

DETAILED DESCRIPTION

Figure 5A:
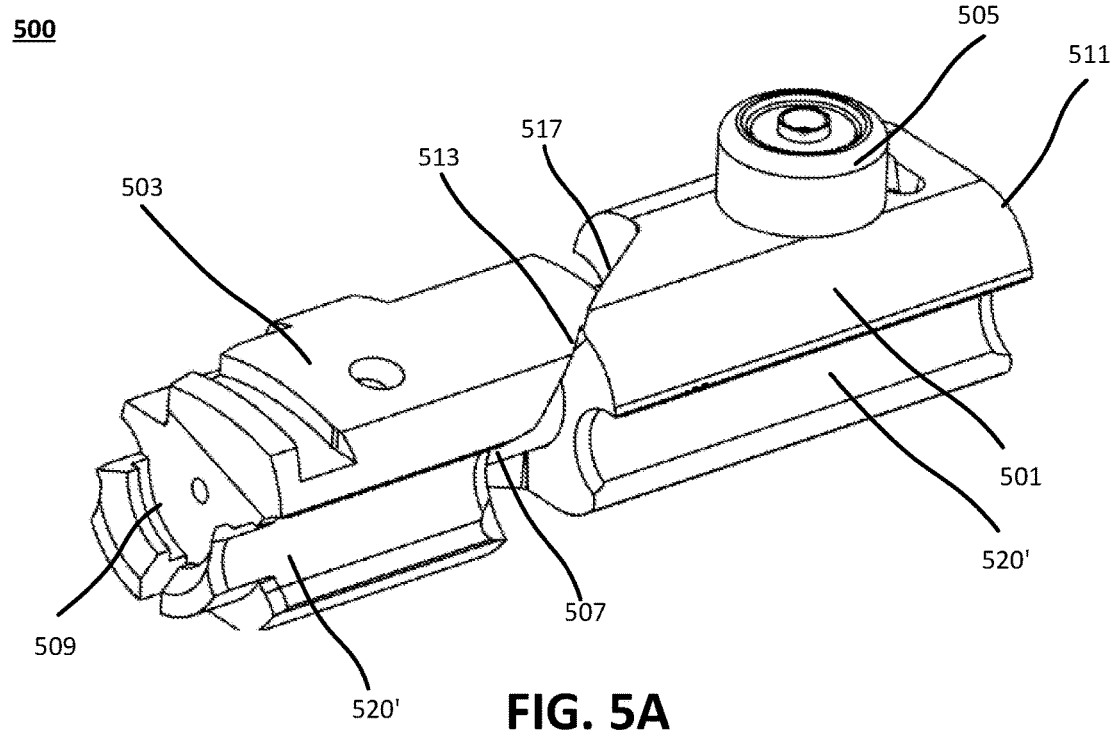
FIG. 5A is a right side perspective view of one example of a firearm bolt assembly consistent with the present disclosure.
Figure 5B:
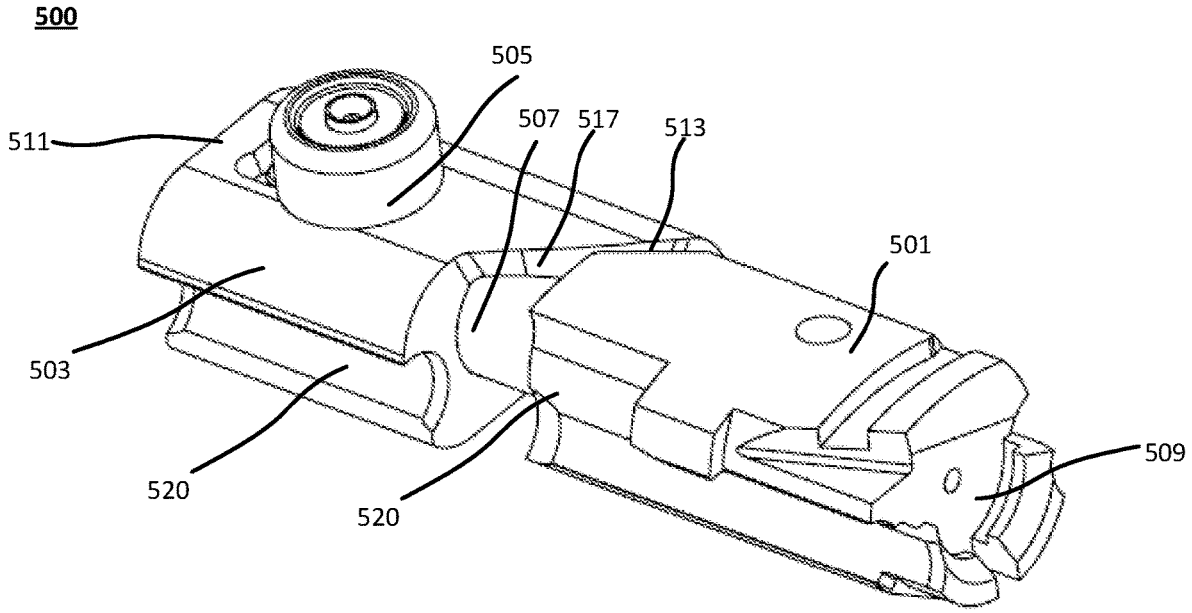
FIG. 5B is a left side perspective view of one example of a firearm bolt assembly consistent with the present disclosure.

As noted previously the Dillon bolt improved upon the GE bolt in part through the inclusion of two cam assemblies on opposites sides of a firearm bolt assembly. However, the two cam assemblies in the Dillon bolt are each defined by a male cam arm and a female cam slot, both of which include two helical cam surfaces. Thus, in the Dillon bolt, each of the cam assemblies each include two pairs of cam surfaces—one pair that interact during compression of the bolt, and another pair that interact during retraction of the bolt. Due to the geometry of the cam assemblies in the Dillon bolt, loads generated during compression and retraction of the bolt during a firing cycle may be concentrated at the neck of each cam arm. Over time such loads can lead to the failure of one or both cam arms, and potentially to failure of the entire firearm bolt assembly. Thus, while the Dillon bolt has proven to be more durable than the GE bolt, there remains a need and desire in the art for firearm bolt assemblies that are even more durable than the Dillon bolt and yet remain compatible with existing firearm designs—particularly rotary firearm designs such as the M-134.

The present disclosure generally relates to firearm bolt assemblies that differ from the Dillon and GE bolts, yet remain compatible with existing firearm designs such as the M-134. As will be described in detail, the firearm bolt assemblies presented herein include a first side, a second side, a proximal end, and a distal end, wherein the first side is substantially opposite the second side. The firearm bolt assemblies further include a bolt body, a bolt that is movable relative to the bolt body, a first cam system, and a second cam system. The first cam system is defined by only a pair of single first complementary cam surfaces that are each proximate the first side of the firearm bolt assembly, wherein the bolt head comprises one of the pair of single first complementary cam surfaces, and the bolt body comprises another of the pair of single first complementary cam surfaces. The second cam system is defined by only a pair of single second complementary cam surfaces that are each proximate the second side of the firearm bolt assembly, wherein the bolt head comprises one of the pair of single second complementary cam surfaces, and the bold body comprises another of the pair of single second complementary cam surfaces.

In embodiments, the firearm bolt assemblies described herein can transition from an initial position to a firing position by compression of the bolt body towards to the proximal end of the bolt assembly, during which a predominant compression force is born by (e.g., born only by) the first cam system. In such embodiments the firearm bolt assemblies may transition from the firing position to the initial position by retraction of the bolt body away from the proximal end of the firearm bolt assembly, during which a predominant compression force is born by (e.g., born only by) the second cam system. In some embodiments, the predominant compression force during compression of the bolt body towards the proximal end is a pushing force that is directed towards the proximal end of the firearm bolt assembly. In contrast the predominant compression force during retraction of the bolt body away from the proximal end is a pulling force that is directed towards the distal end of the firearm bolt assembly.

In embodiments one of the pair of single first complementary cam surfaces is a first helical cam surface and the other of the pair of single first complementary cam surfaces is a second helical cam surface that is complementary to the first helical cam surface. When the firearm bolt assembly is moved from the initial position to the firing position, interaction of the first and second helical cam surfaces causes the bolt head to twist, relative to the bolt body, in a first direction about an axis extending through the bolt head and the bolt body. In such instances, one of the pair of single second complementary cam surfaces is a third helical cam surface and the other of the pair of single second complementary cam surfaces is a fourth helical cam surface that is complementary to the third helical cam surface. When the firearm bolt assembly is moved from the firing position to the initial position, interaction of the third and fourth helical cam surfaces causes the bolt head to twist, relative to the bolt body, in a second direction about the axis extending through the bolt head and bolt body, wherein the second direction is substantially opposite the first direction.

In embodiments the first helical cam surface and second helical cam surfaces are disposed proximate the top of the firearm bolt assembly, and the third and fourth helical cam surfaces are disposed proximate the bottom of the firearm bolt assembly. The first and third helical cam surfaces are defined by part of the bolt head, and the second and fourth helical cam surfaces are defined by a part of the bolt body. Movement of the firearm bolt assembly from the initial position to the firing position imparts a predominant compression force (pushing force) in the direction of the proximal end of the firearm bolt assembly, which causes the second helical cam surface to urge (e.g., be pushed) against the first cam surface. In contrast, movement of the firearm bolt assembly from the firing position to the initial position imparts a predominant compression force (pulling force) in the direction of the distal end of the firearm bolt assembly, which causes the fourth helical cam surface to urge (e.g., be pulled against) the third helical cam surface.

The firearm bolt assemblies described herein may further include a firing pin that is disposed within a bore formed in the bolt head and the bolt body. The firing pin may be biased by a firing pin spring. In such embodiments the firearm bolt assembly may be configured such that the spring is loaded (e.g., compressed) when the bolt body is compressed towards the bolt head as the firearm bolt assembly is moved from the initial position to the firing position. For example, the firearm bolt assembly may include a spring stop, a reset pin, a release pin, and a release channel. In embodiments the spring stop is positioned within the portion of the bore formed in the bolt body and includes a through hole through which the reset pin is disposed. The reset pin may extend into and/or through an opening formed in a sidewall of the bolt body. The release channel may be in the form of an L-shaped slot formed through a sidewall of the bolt head. The L-shaped slot may include a vertical leg and a longitudinal leg. In such embodiments a proximal portion of the release pin extends into the portion of the bore formed in bolt head, and a distal portion of the release pin extends into the L-shaped slot.

When the firearm bolt assembly is in the initial position, a portion of the release pin is present within the vertical leg of the L-shaped slot. As the firearm bolt assembly is moved from the initial position to the firing position, the bolt body is compressed towards the bolt head and the bolt head twists in a first direction relative to the bolt body due to the interaction of the pair of first single complementary cam surfaces. As the bolt body moves toward the bolt head but before the firing position is reached, the distal portion of the release pin is disposed within the vertical leg of the L-shaped slot. Consequently, movement of the bolt body towards the bolt head causes the spring stop to compress the firing pin spring and cock the firing pin. As the bolt head twists in the first direction relative to the bolt head, the distal end of the release pin moves within the vertical leg of the L-shaped slot towards the longitudinal leg. When firearm bolt assembly reaches the firing position, the bolt head is twisted enough in the first direction (relative to the bolt body) to cause the release pin to move into the longitudinal leg of the L-shaped slot. Movement of the release pin into the longitudinal leg releases the firing pin, causing the firing pin to strike the primer of a cartridge (if any) chambered in the firearm bolt assembly.

After the firearm bolt assembly reaches the firing position, the firearm bolt assembly may return from to the initial position by retracting the bolt body away from the bolt head. Immediately following the firing position, the release pin resides within the longitudinal leg of the L-shaped slot. As the bolt body is retracted away from the bolt head, the bolt head twists, relative to the bolt body, in a second direction about an axis extending through the bolt head and the bolt body, wherein the second direction is substantially opposite the first direction. As the bolt head twists in the second direction, the release pin moves within the longitudinal leg toward the vertical leg of the L-shaped slot. Eventually, retraction of the bolt body relative to the bolt head causes the release pin to move into the vertical leg of the L-shaped slot. At that or a later point, the bolt head is realigned with the bolt body, and the firearm bolt assembly is ready for another firing cycle.

As used herein, the phrases "only a pair of single first complementary cam surfaces" and "only a pair of single second complementary cam surfaces" are used in connection with first and second cam assemblies, respectively. In the context of the present disclosure, such phrases mean that the first cam system is made up of only two (i.e., two single) complementary cam surfaces, and the second cam system is made up of only two (i.e., two single) complementary cam surfaces. As will become apparent from the following description, in embodiments the first cam system is formed by only a single (first) cam surface on or formed by a bolt head, and a single (second) cam surface on or formed by a bolt body. Likewise, the second cam system is formed by only a single (third) cam surface on or formed by a bolt head, and only a single (fourth) cam surface on or formed by a bolt body. The first and second cam assemblies may be disposed on substantially opposite sides of a firearm bolt assembly.

As used herein, the term "substantially opposite" means opposite or nearly opposite (e.g., opposite within a +/− 30% deviation tolerance, such as a +/− about 20%, +/− about 10%, or even +/− about 5% deviation tolerance). In some embodiments, "substantially opposite" means opposite or nearly opposite within a +/− 5% deviation tolerance.

As used herein, the term "complementary" when used regarding two cam surfaces means that the two cam surfaces define substantially opposite surface profiles that are designed to slide against one another during movement of a firearm bolt assembly from an initial position to a firing position, from the firing position to the initial position, or both.

As used herein, the term "predominant compressive force" when used regarding the compression of a firearm bolt assembly (e.g. as the bolt assembly is moved from the initial position to the firing position), means the (pushing) force directed towards the proximal end of the bolt assembly (i.e., towards the bolt head). In contrast the term "predominant compressive force" when used regarding retraction of firearm bolt assembly (e.g., as the bolt assembly is moved from the firing position to the initial position), means the (pulling) force directed towards the distal end of the firearm bolt assembly (i.e., towards the bolt body).

As discussed above the firearm assemblies presented herein utilize first and second cam systems that are each defined only by a pair of single complementary cam surfaces. The cam systems are configured such that the first cam system bears the predominant compressive forces that are imparted during movement of the firearm bolt assembly from an initial position to the firing position to a first side of the firearm bolt, whereas the second cam system bears the predominant compressive forces that are imparted during movement of the firearm bolt assembly from the firing position to the initial position to a second side of the bolt. In other words, the cam systems are configured such that the predominant compressive forces imparted during movement from the initial position to the firing position are localized to one portion (e.g., side) of the firearm bolt assembly, whereas the predominant compressive forces imparted during movement from the firing position to the initial position are localized to another portion (e.g., another side) of the firearm bolt assembly.

The predominant compressive forces imparted during movement from the initial position to the firing position may be greater than the predominant compressive forces imposed during movement from the firing position to the initial position. This is because during movement from the initial to the firing position, the compression force needs to overcome the expansion spring force of the firing pin spring. In contrast, movement of the firearm bolt assembly from the firing position to the initial position may be aided by the spring force of the firing pin spring. Consequently, the first and second cam assemblies may be configured such that the first cam system may withstand a greater applied compression force than the second cam system.

Put in other terms, in embodiments the firearm bolt assemblies described herein include first and second cam assemblies, wherein the first and second cam assemblies are configured such that only the first cam system bears the predominant compressive forces imparted during compression of the bolt body towards to the bolt head, whereas only the second cam system bears the predominant compressive forces imparted during retraction of the bolt body away from the bolt head. Because the predominant compressive forces applied during compression of the bolt body towards the bolt head compress a firing pin spring, such forces are larger than the compressive forces that are applied during retraction of the bolt body away from the bolt head. Consequently, the first cam system may have a wider/thicker neck, relative to a neck of the second cam system. As such, the first cam system may be able to withstand a larger amount of compression force relative to the second cam system.

Figure 5C:
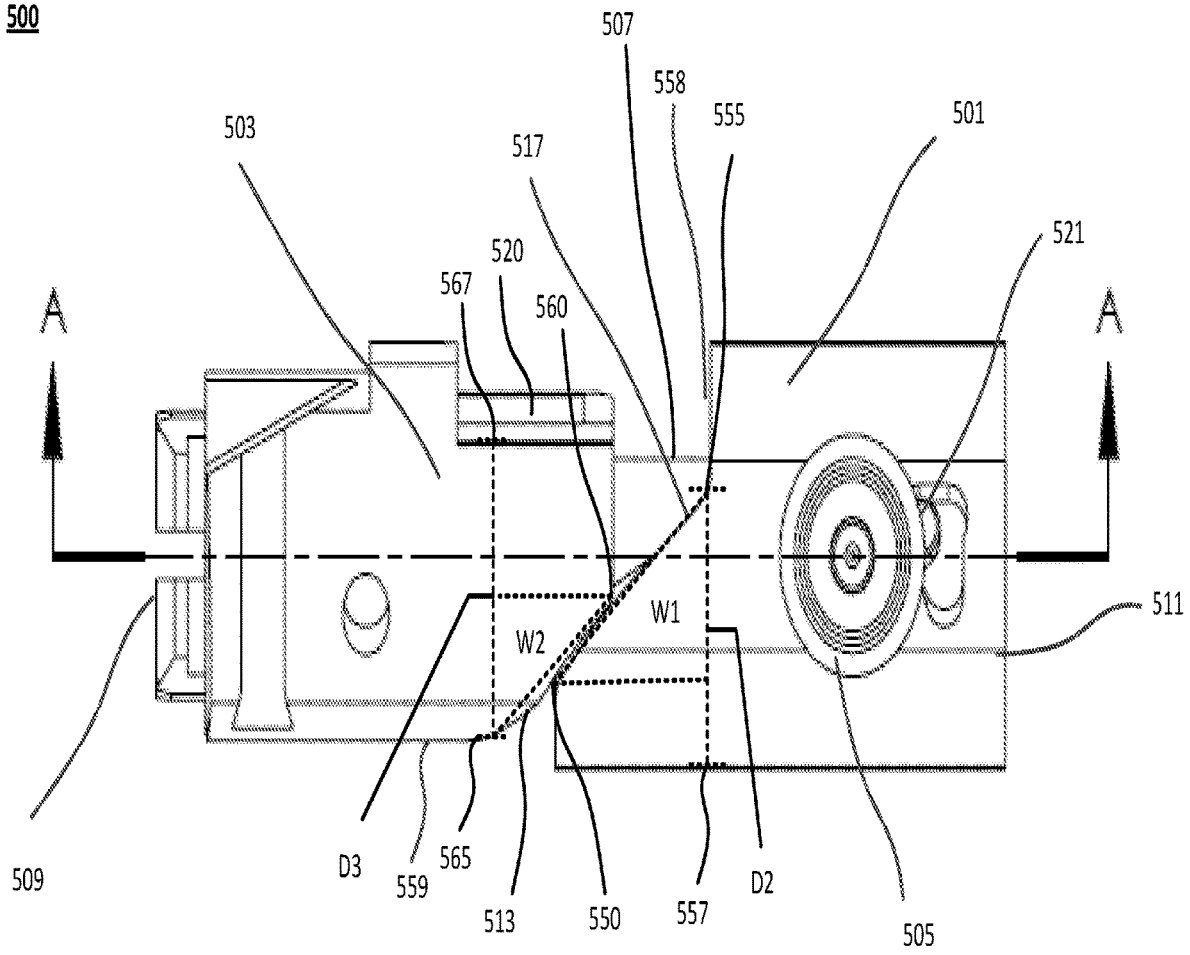
FIG. 5C is a top view of one example of a firearm bolt assembly consistent with the present disclosure.
Figure 5D:
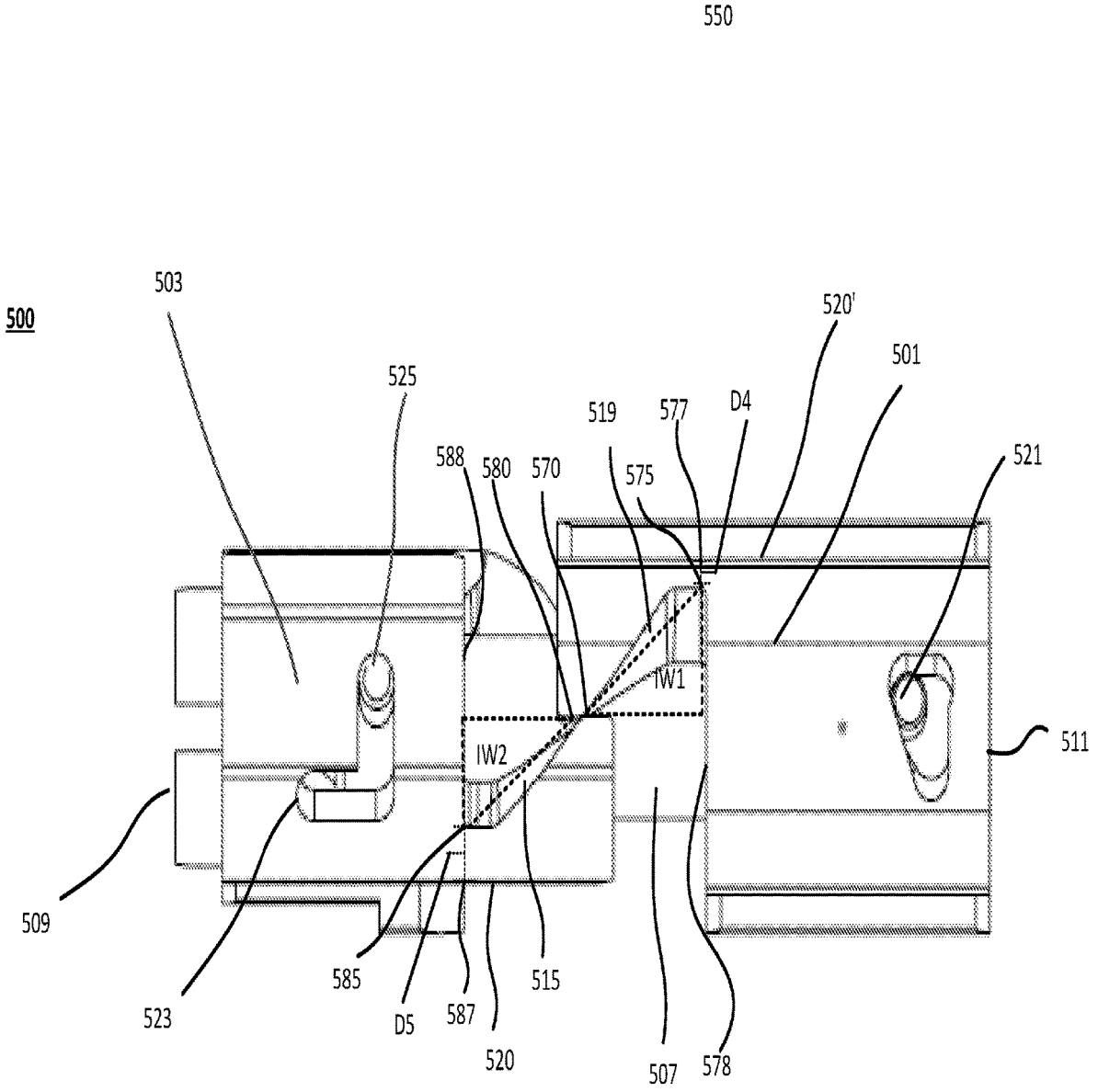
FIG. 5D is a bottom view of one example of a firearm bolt assembly consistent with the present disclosure.
Figure 5E:
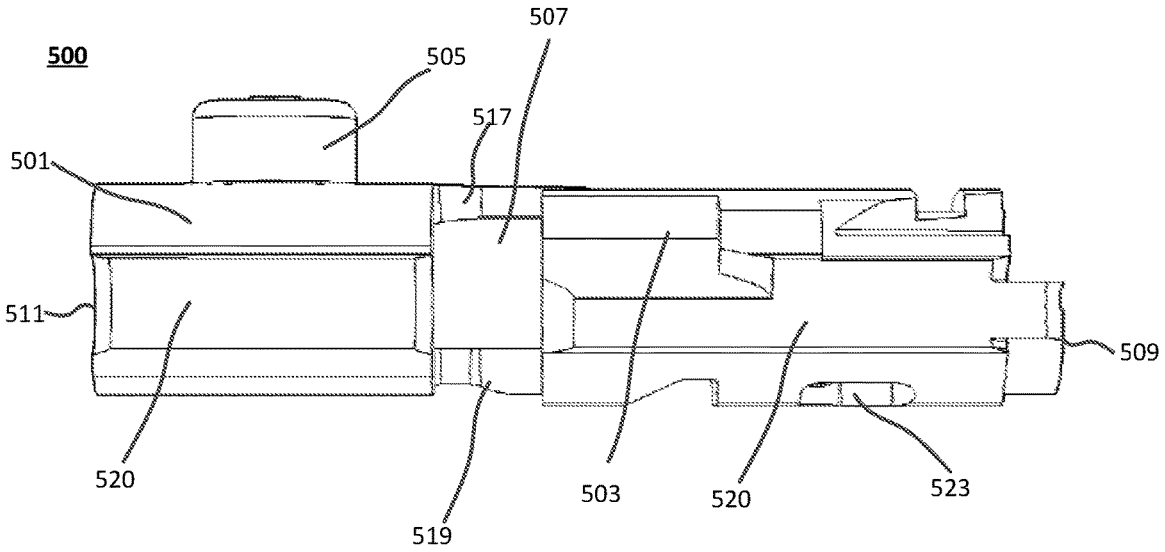
FIG. 5E is a left side view of one example of a firearm bolt assembly consistent with the present disclosure.
Figure 5F:
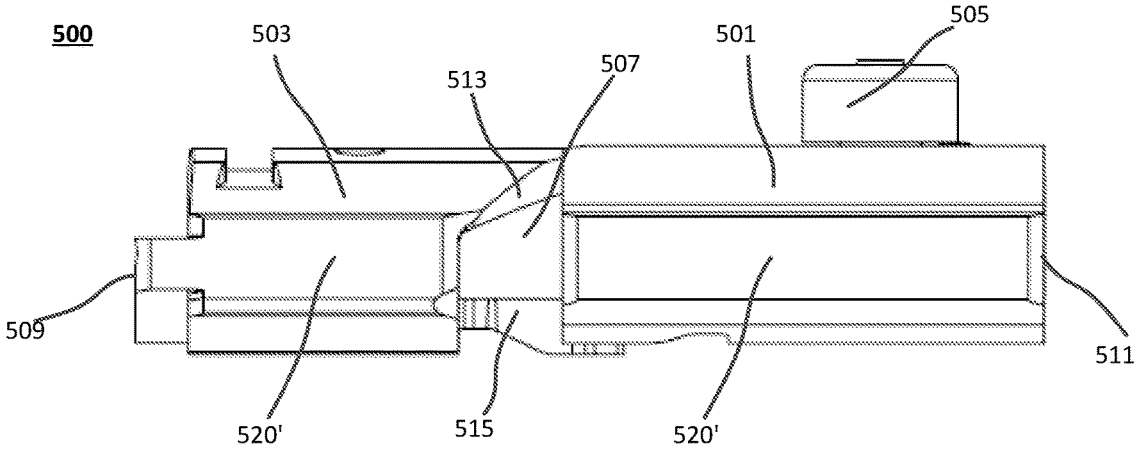
FIG. 5F is a right side view of one example of a firearm bolt assembly consistent with the present disclosure.
Figure 5G:
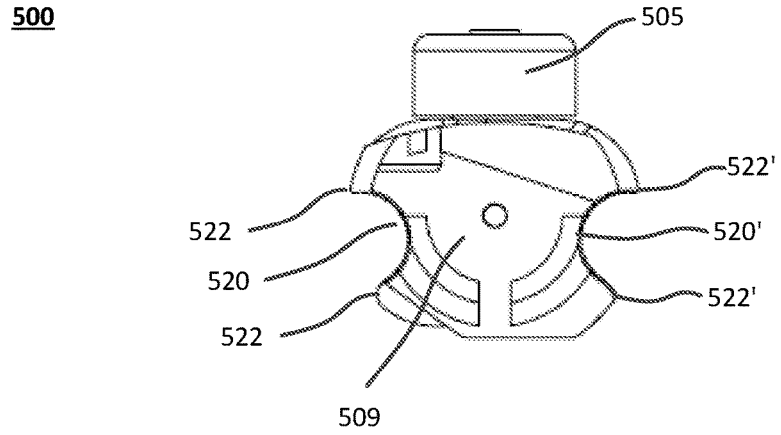
FIG. 5G is a front view of one example of a firearm bolt assembly consistent with the present disclosure.
Figure 5H:
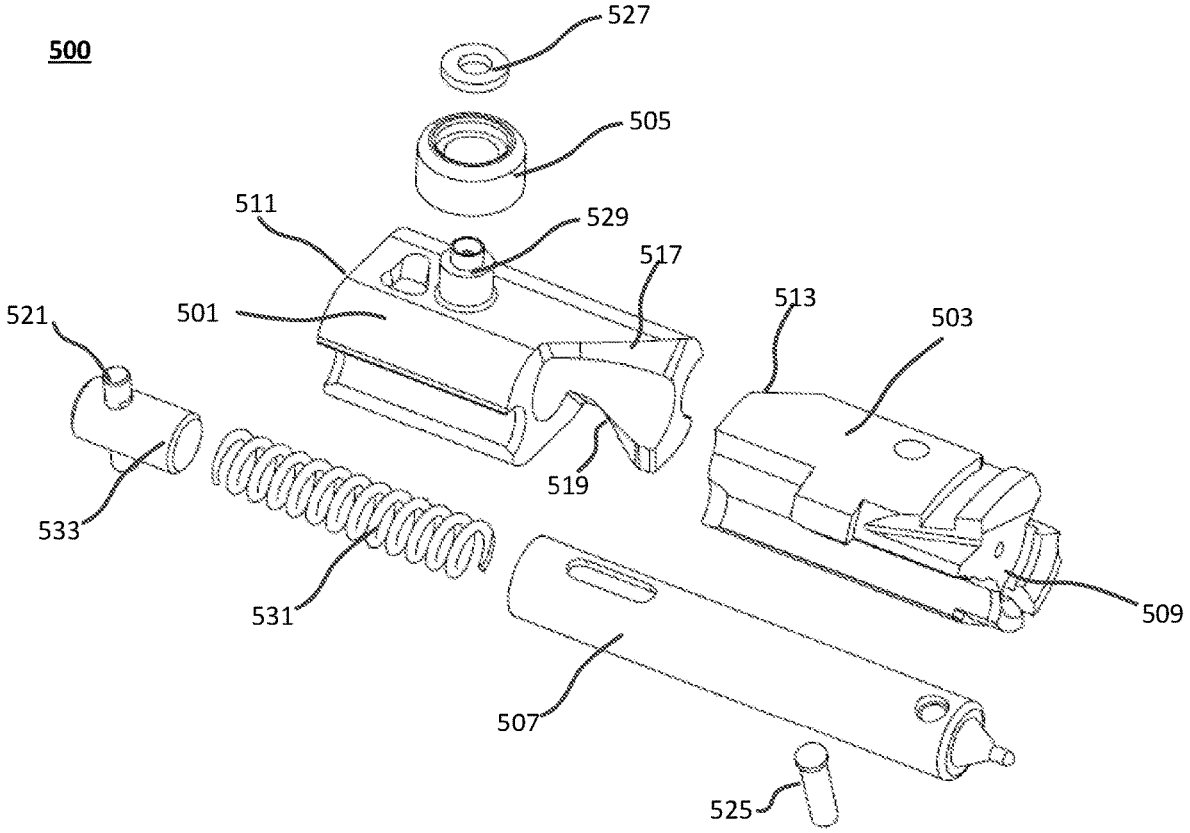
FIG. 5H is an exploded perspective view of one example of a firearm bolt assembly consistent with the present disclosure.
Figure 5I:
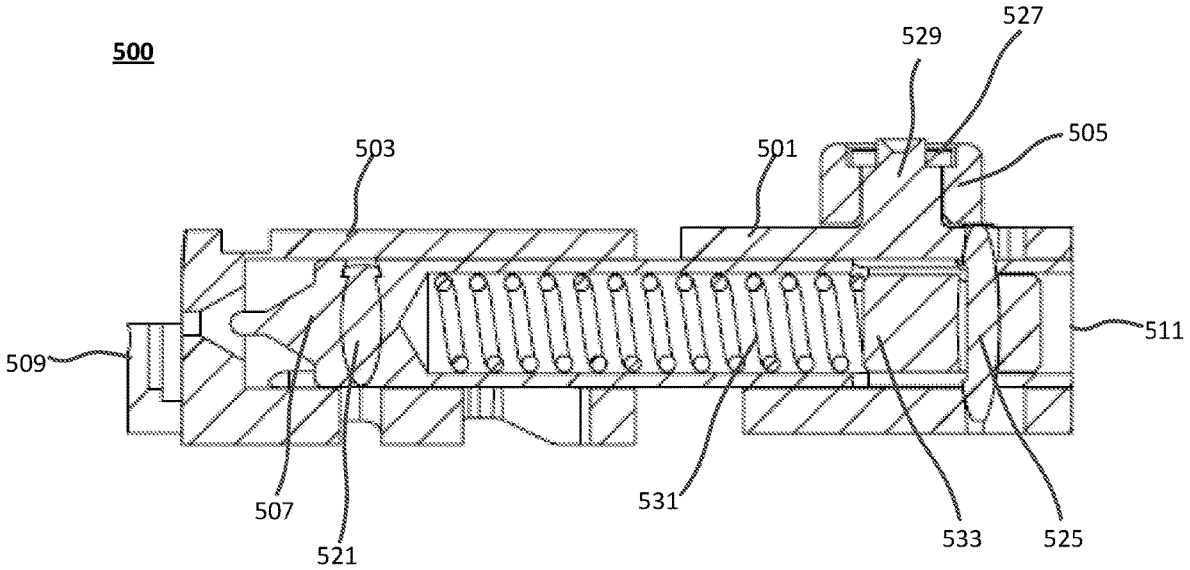
FIG. 5I is a cross sectional view of one example of a firearm bolt assembly consistent with the present disclosure.

FIGS. 5A-5I depict various views of one example of a firearm bolt assembly 500 consistent with the present disclosure. As shown, firearm bolt assembly 500 includes a bolt body 501 and a bolt head 503. A cam roller 505 is coupled by a cam roller washer 527 to a cam roller post 529 that extends from a top of the bolt body 501, as best shown in FIG. 5H. Cam roller 505 is configured to ride within a helical track in the housing of a rotary firearm such as the M-134, as understood in the art. A firing pin 507 is disposed in a bore (not labeled) within bolt body 501 and bolt head 503, as best shown in FIGS. 5A, 5B, 5H, and 5I. The bore and the firing pin 507 may be disposed coaxial with a central axis A when the firearm bolt assembly 500 is in an assembled state, as best shown in FIG. 5C. The firing pin may be biased by a firearm spring 531, as best shown in FIG. 5H. The firearm bolt assembly 500 may further include a spring stop 533 and a reset pin 521 coupled to or disposed within the spring stop 533, as shown in FIG. 5H. The firearm bolt assembly 500 may also include a release channel 523 formed in the bolt head 503, and a release pin 525 that moves within the release channel 523 as the firearm bolt assembly 500 is moved between an initial position and a firing position. As shown in FIG. 5D the release channel 523 may be in the form of an L-shaped slot having a vertical leg and a longitudinal leg.

As best shown in FIGS. 5A and 5D, the bolt head 503 includes a first cam surface 513 and a second cam surface 515, and the bolt body includes a third cam surface 517 and a fourth cam surface 519. The first and third cam surfaces 513, 517 are disposed proximate one side (e.g. the top) of the firearm bolt assembly 500, whereas the second and fourth cam surfaces (515, 519) are disposed proximate an opposing (e.g., bottom) side of the firearm bolt assembly 500. When the firearm bolt assembly is in an assembled state, the first and third cam surfaces 513, 517 form a first cam system that is disposed proximate one side of the firearm bolt assembly 500 (e.g., the top), and the second and fourth cam surfaces 515, 517 form a second cam system that is disposed proximate an opposing (e.g., bottom) side of the firearm bolt assembly 500. Accordingly, the first cam system is defined by only a pair of single first cam surfaces (i.e., first and third cam surfaces 513, 517), and the second cam system is defined by only a pair of single second cam surfaces (i.e., second and fourth cam surfaces 515, 519).

The third cam surface 517 is designed to slide against the first cam surface 513 as the firearm bolt assembly 500 is moved from an initial position to a firing position. Thus, the first and third cam surfaces 513, 517 should each be understood to be one of a pair of first single complementary cam surfaces. Similarly, the fourth cam surface 519 is designed to slide against the second cam surface 515 as the firearm bolt assembly is moved from the firing position to the initial position. Thus, such surfaces may should also be understood to be one of a pair of second complementary cam surfaces. Accordingly, the first cam system is defined by only a pair of single first complementary cam surfaces (513, 517), and the second cam system is defined by only a pair of single second complementary cam surfaces (515, 519)

The first and second cam systems are rotation imparting structures that cause the bolt head 503 to rotate (twist) relative to the bolt body 501 as the firearm bolt assembly 500 is moved from an initial position to a firing position, and vice versa. In that regard, the first and third cam surfaces 513, 517 making up the first cam system may be in the form of first complementary helical cam surfaces, and the second and fourth cam surfaces 515, 519 may be in the form of second complementary helical cam surfaces. The first complementary helical cam surfaces may be the same or different from the second complementary helical cam surfaces. In embodiments, the second complementary helical cam surfaces are substantial opposites of the first complementary helical cam surfaces. Of course, the use of helical cam surfaces is not required and cam surfaces having any other suitable shape that causes bolt head 503 to twist relative to bolt body 501 as the bolt body 501 is compressed or retracted from bolt head 503 may also be used.

Figure 6A:
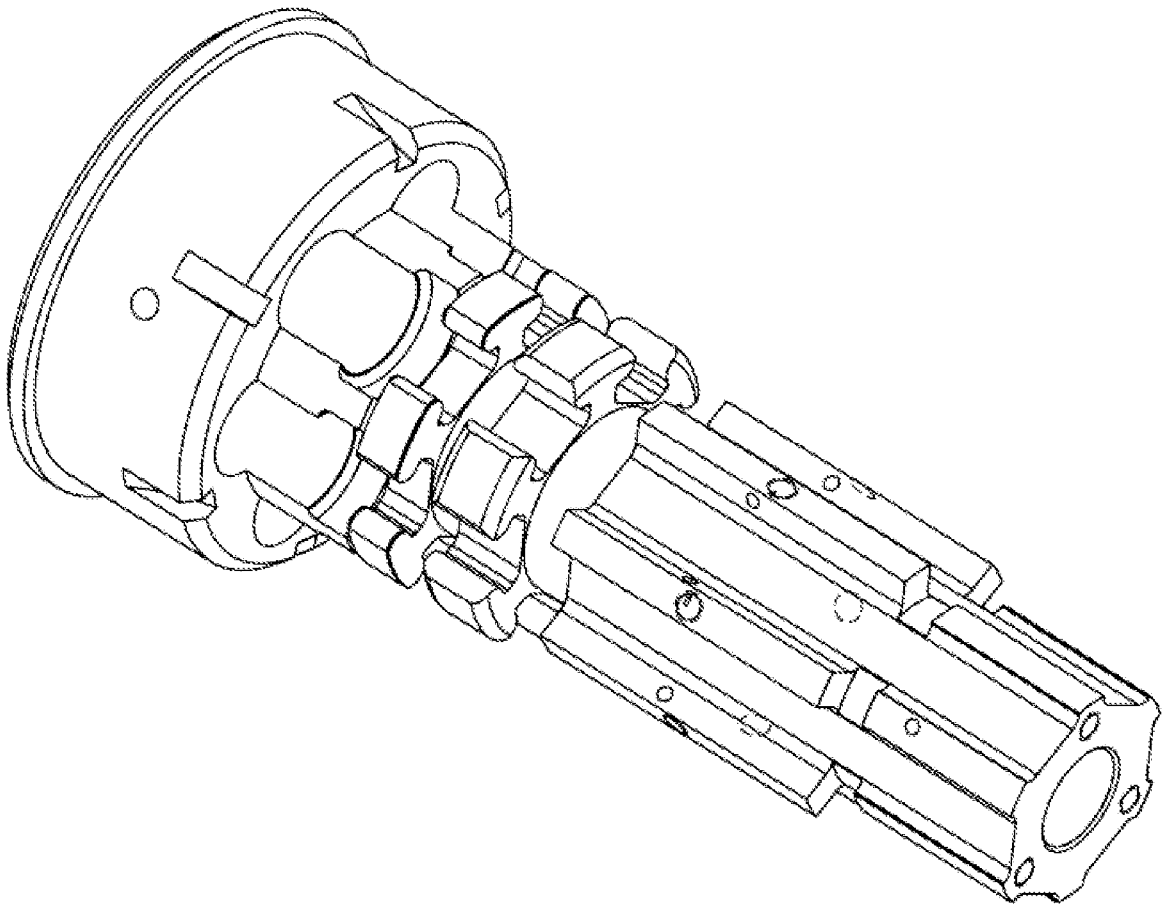
FIG. 6A is a perspective view of one example of a firearm rotor for use in a machine gun.
Figure 6B:
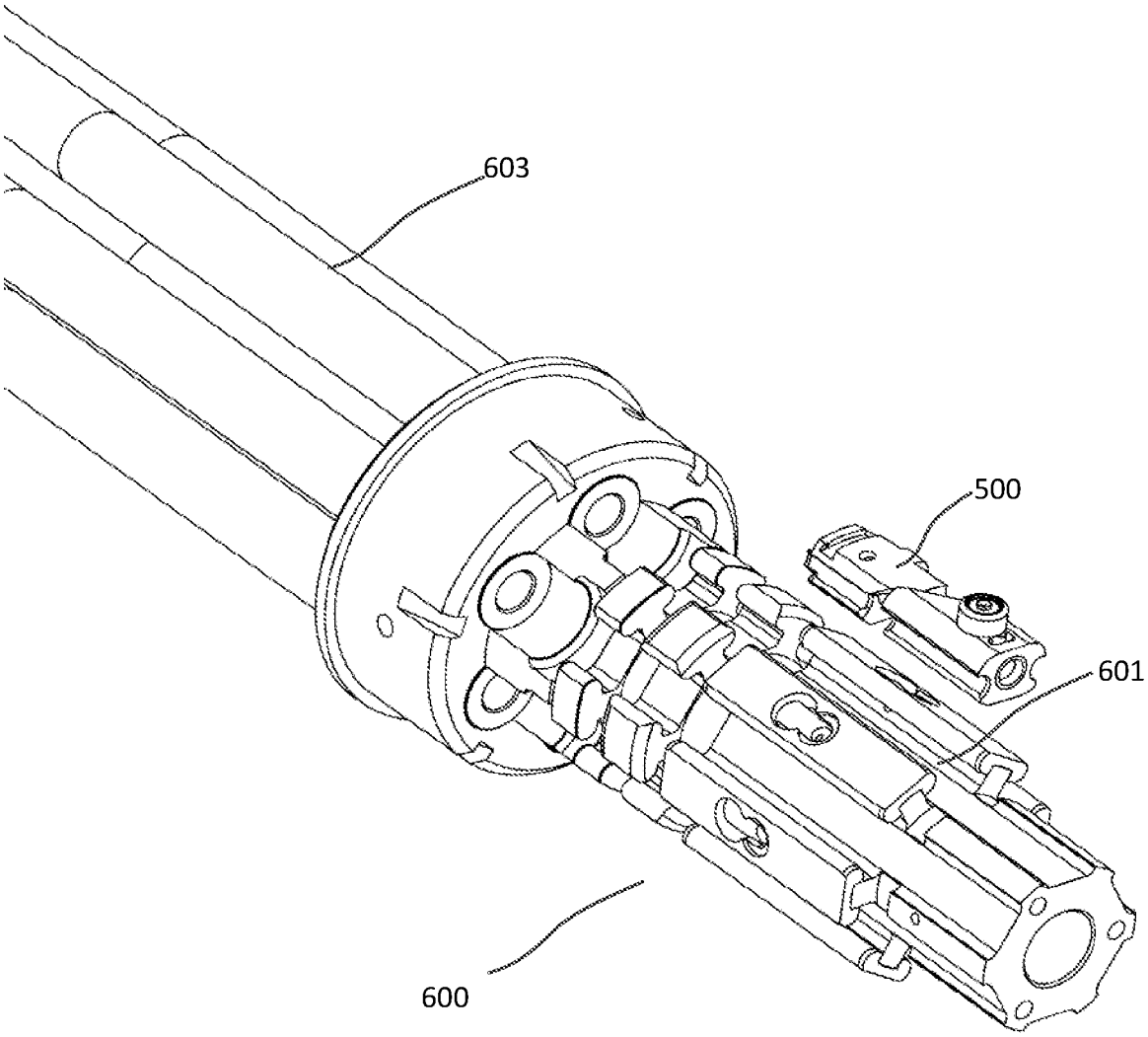
FIG. 6B is a perspective view of a rotor and a firearm bolt assembly for use in a machine gun consistent with the present disclosure.
Figure 6C:
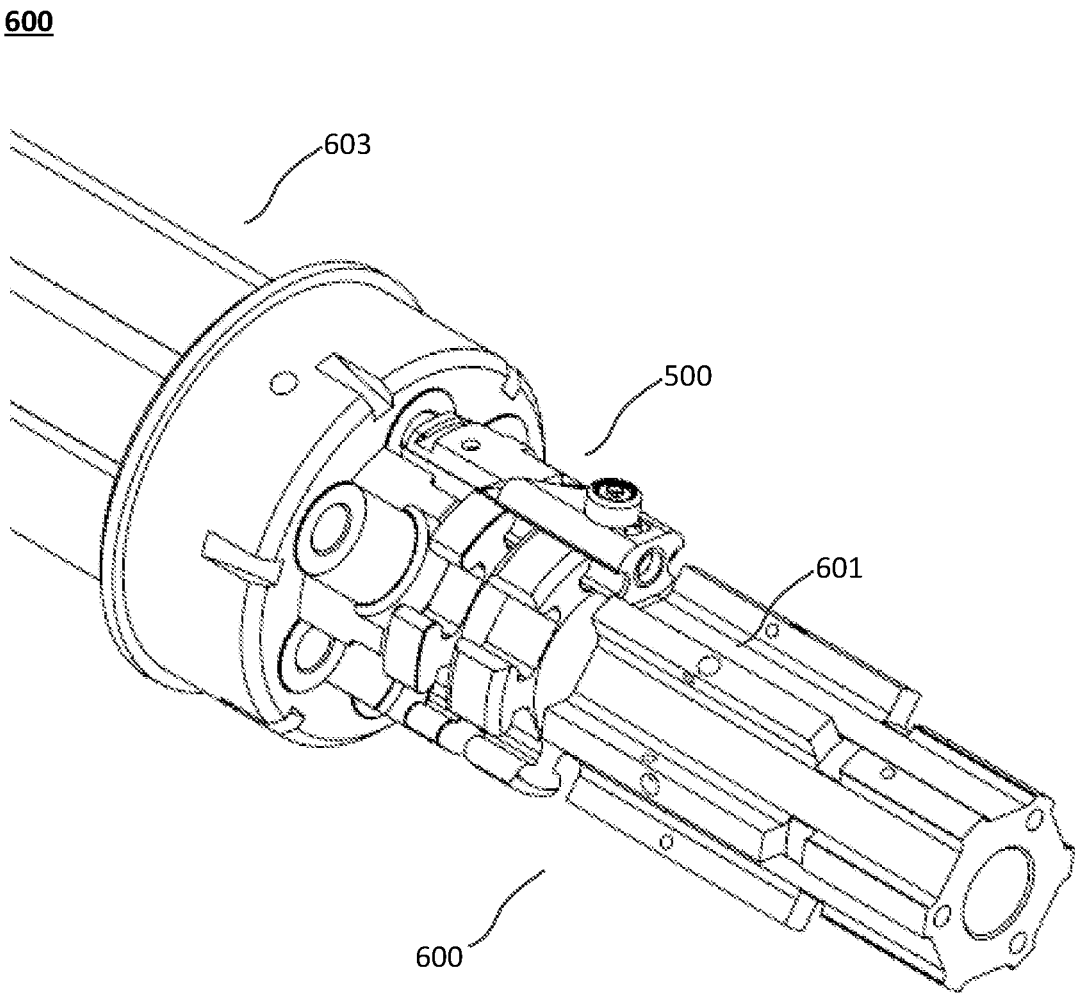
FIG. 6C is a perspective view of machine gun including a firearm bolt assembly consistent with the present disclosure mounted in a track of a rotor.

Like the Dillon and GE bolts the firearm bolt assemblies of the present disclosure are designed to move between an initial position to a firing position as the firearm bolt assembly is used to fire cartridge ammunition, discharge spent cartridges, and chamber a next cartridge. And like the Dillon and GE bolts, the firearm bolt assembly 500 includes track slots 520, 520' that are designed to allow the firearm bolt assembly 500 to ride within a track of a rotor of a rotary firearm, e.g., a machine gun such as the M-134. That concept is best shown in FIGS. 6A-6E (which show the firearm bolt assembly 500 in the context of a machine gun such as the M-134) and FIGS. 7A-7B (which provide a sequence of views of a firearm bolt assembly as it moves between an initial position to a firing position and back to the initial position). More specifically and as best shown in FIGS. 6B and 6C, the track slots 520, 520' are configured to ride on/within a corresponding track 601 of a rotor 600 of a machine gun such as an M-134 type minigun.

Figure 6D:
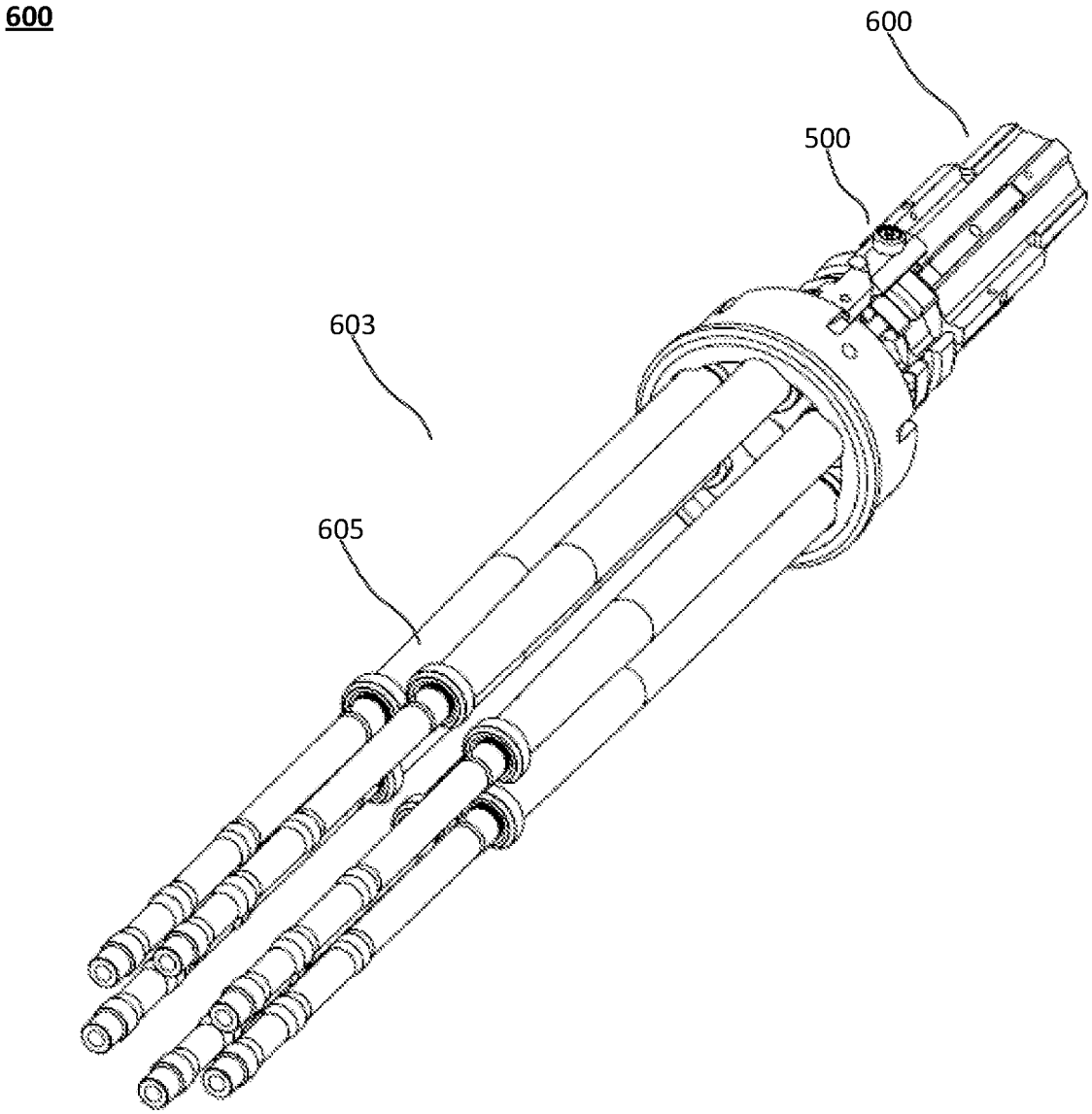
FIG. 6D is another perspective view of a machine gun including a firearm bolt assembly consistent with the present disclosure mounted in a track of a rotor.
Figure 6E:
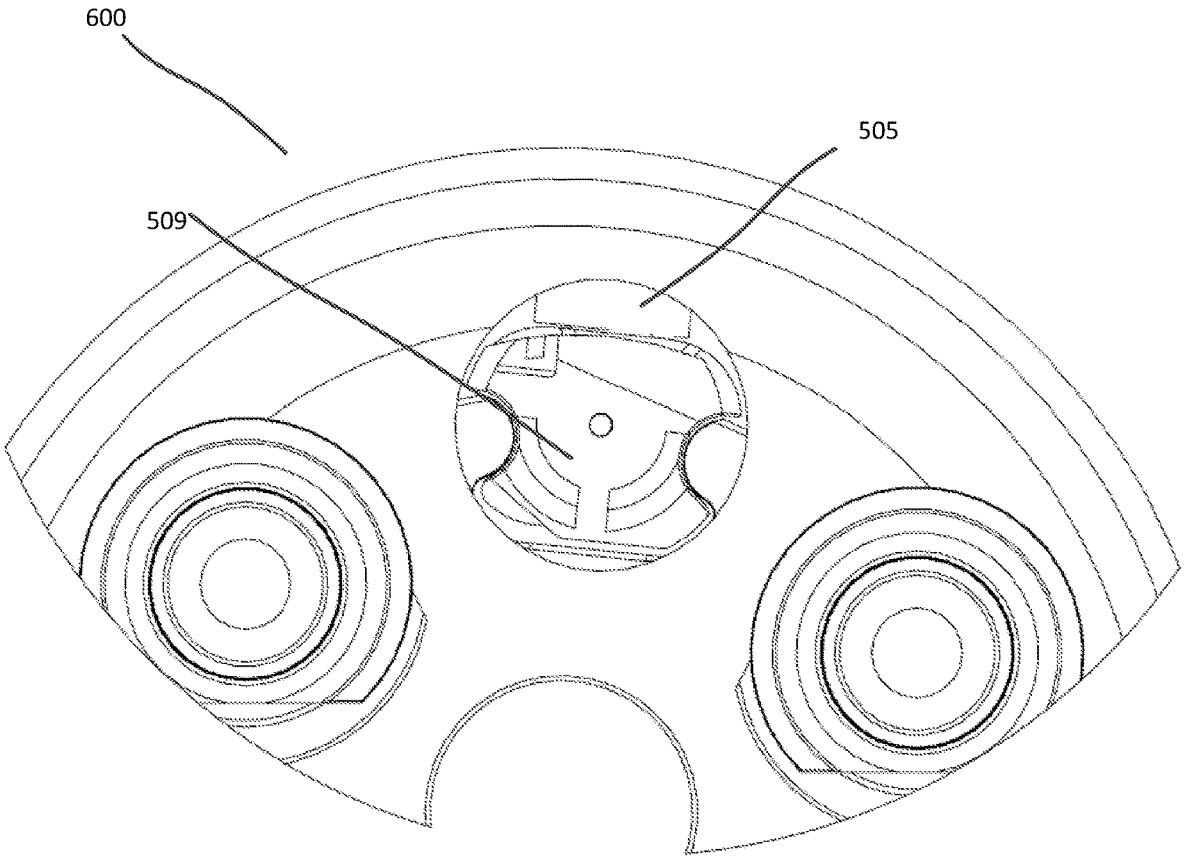
FIG. 6E is an enlarged front view of a machine gun including a firearm bolt assembly consistent with the present disclosure mounted in a track of a rotor.
Figure 7A:
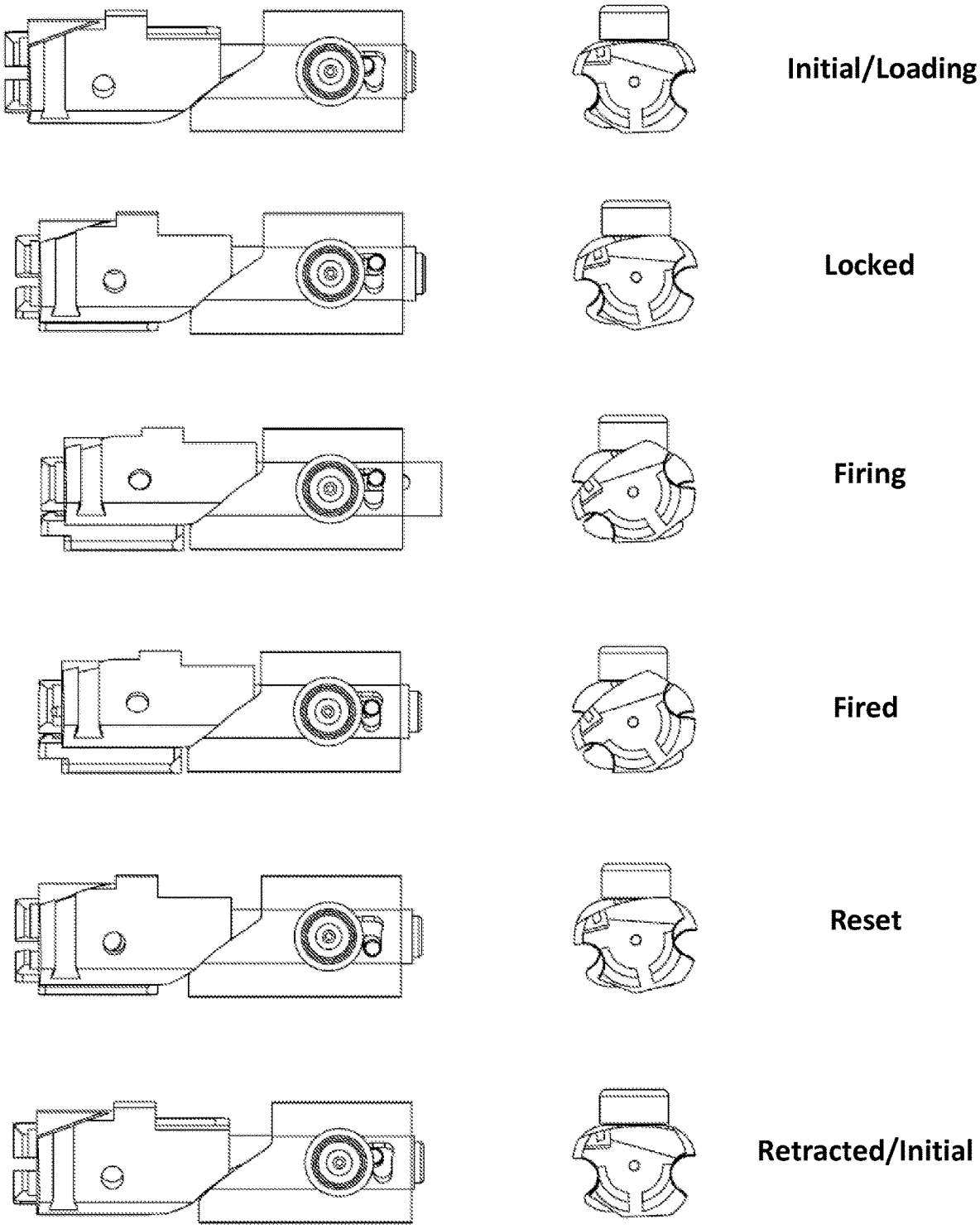
FIG. 7A is a series of top views depicting movement of a firearm bolt assembly consistent with the present disclosure between an initial position and a firing position.

Although not shown in FIGS. 6A-6E, when the firearm bolt assembly 500 is seated within the track 601, the cam roller 505 is disposed within a helical track that is formed within the housing of the receiver of the firearm. Like the operation of the Dillon and GE bolts, as the rotor 600 rotates the cam roller 505 moves within the helical track and urges the firearm bolt assembly 500 towards one end of a barrel 605 included in a barrel assembly 603. Prior to reaching the end of the barrel 605, an ammunition cartridge (not shown) may be received by the firearm bolt assembly 500 (e.g., from a de-linker—not shown). As the cam roller 505 moves forward within the helical track, the proximal end 509 of the firearm bolt assembly 500 is eventually positioned against the end of the barrel 605, as best shown in FIGS. 6C and 6D. At that point the firearm bolt assembly 500 is in the initial position, which is also shown in FIGS. 5A-5I and FIGS. 7A-7B.

After the proximal end 509 is positioned against the end of the barrel 605, the cam roller continues to ride forward in the helical path. With reference to FIGS. 5A, 5C, 7A, and 7B as the cam roller 505 continues forward in the helical path, force is applied to the cam roller 505 and is transferred to the bolt body 501 in a direction towards the proximal end 509. That force causes the pair of single complementary cam surfaces of the first cam system to interact with one another, causing the bolt head 503 to rotate relative to the bolt body 501. More specifically, as the body 501 is urged towards the proximal end 509 the third cam surface 517 is compressed against the first cam surface 513. Because the first and third cam surfaces 513, 517 are complementary helical cam surfaces, compression of the third cam surface 517 against the first cam surface 513 causes the bolt head 503 to twist (rotate) about the central axis A in a first direction relative to the bolt body 501. In the illustrated embodiment the first direction is clockwise around the axis A (as the rotor moves clockwise), but the opposite direction could be used by reversing the orientation of the first and second cam systems and running the rotor in a counter clockwise direction.

Figure 7B:
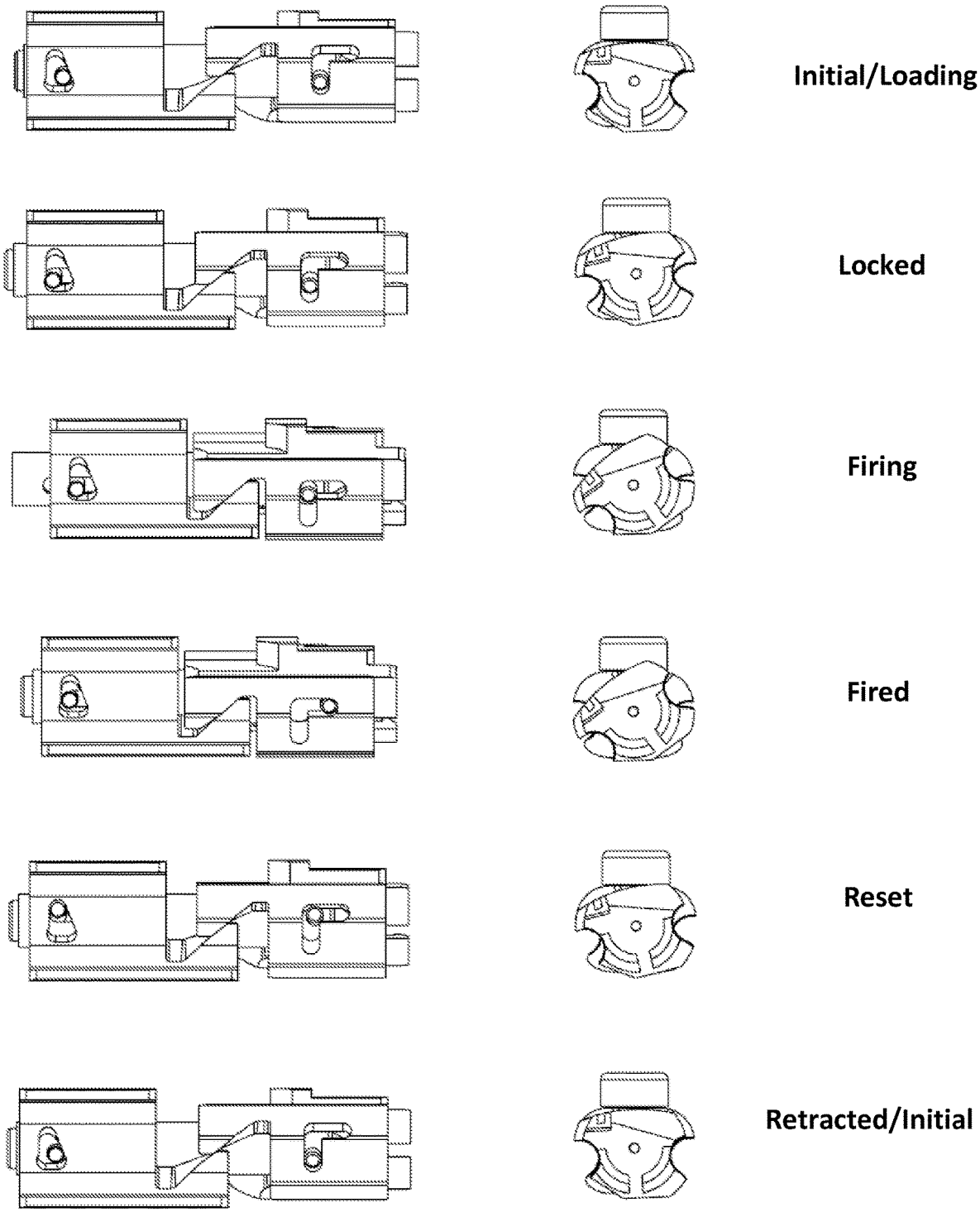
FIG. 7B is a series of bottom views depicting movement of a firearm bolt assembly consistent with the present disclosure between an initial position and a firing position.

When firearm bolt assembly 500 is in the initial position a distal portion of the release pin 525 is present within the vertical leg of release channel 523, as best shown in FIGS. 5D and 7B. As the firearm bolt assembly 500 is moved from the initial position to the firing position, the bolt body 501 is moved towards the bolt head 503 and the bolt head 503 twists in a first direction relative to the bolt body 501 due to the interaction of the first and third cam surfaces 513, 517 (i.e., the pair of first single complementary cam surfaces). As the bolt body 501 moves toward the bolt head 503 but before the firing position is reached, the distal portion of the release pin 525 is disposed within the vertical leg of release channel 523. Consequently, movement of the bolt body 501 towards the bolt head 503 causes the spring stop 533 (shown in FIGS.

5H and 7B) to compress the firing pin spring 531 and cock the firing pin 507. As the bolt head 503 twists in the first direction relative to the bolt body 501, the distal end of the release pin 525 moves within the vertical leg of the release channel 523 towards the longitudinal leg of the release channel 523. When firearm bolt assembly 500 reaches the firing position, the bolt head 503 is sufficiently twisted in the first direction (relative to the bolt body 501) to cause the release pin 525 to move into the longitudinal leg of the release channel 523, as best shown in FIG. 7B. Movement of the release pin 525 into the longitudinal leg releases the firing pin 507, causing the firing pin 507 to strike the primer of a cartridge (if any) chambered in the firearm bolt assembly 500.

After the firearm bolt assembly 500 reaches the firing position the cam roller 505 moves rearwardly within the helical track to return the firearm bolt assembly 500 to the initial position. More specifically and with reference to FIGS. 5D, 7A, and 7B, after the firearm bolt assembly 500 reaches the firing position the cam roller 505 is moved rearward in the helical track. As the cam roller 505 moves rearward, force applied to the cam roller 505 is transferred to the bolt body 501 in a direction towards the distal end 511. That force causes the pair of single complementary cam surfaces of the second cam system to interact with one another, causing the bolt head 503 to rotate relative to the bolt body 501. More specifically, as the cam roller 505 is driven towards the distal end 509, the fourth cam surface 519 is compressed against the second cam surface 515. Because the third and fourth cam surfaces 515, 519 are complementary helical cam surfaces that are substantially opposite the helical cam surfaces 513, 517, compression of the fourth cam surface 519 against the third cam surface 515 causes the bolt head 501 to twist (rotate) about the central axis A in a second direction relative to the bolt body 503. The second direction is substantially opposite the first direction that the bolt body twisted during movement of the firearm bolt assembly 500 from the initial position to the firing position.

More specifically, after the firearm bolt assembly 500 reaches the firing position, the cam roller 505 may move rearward in the helical track within the housing of the firearm. The rearward movement of the cam roller 505 imposes a force on the bolt body 501 in a direction towards the distal end 511. Immediately after the firearm bolt assembly 500 achieves the firing position, the release pin 525 resides within the longitudinal leg of the L-shaped slot 523, as shown in FIG. 7B. Rearward movement of the cam roller 505 causes the bolt body 501 to retract away from the bolt head 503 as discussed above. Such retraction causes the bolt head 503 to twist, relative to the bolt body 501, in a second direction about an axis extending through the bolt head 503 and the bolt body 501, wherein the second direction is substantially opposite the first direction. In this case the second direction is counterclockwise about the axis A, but as noted above the first and second directions could be reversed. As the bolt head 503 twists in the second direction the release pin 525 moves within the longitudinal leg toward the vertical leg of the release channel 523, as shown in FIG. 7B. Eventually, retraction of the bolt body 501 relative to the bolt head 503 causes the release pin 525 to move into the vertical leg of the release channel 523 aided by the interaction of the second and fourth cam surfaces (515, 519) and pin 521. At that or a later point, the bolt head 503 is realigned with the bolt body 501, and the firearm bolt assembly 500 is ready for another firing cycle.

In different terms and with reference to FIG. 5C, the first cam system of the present disclosure may be understood to be defined by first and second wedges, W1 and W2, wherein the first wedge W1 is defined by the bolt body 502, and the second wedge W2 is defined by the bolt head 503. Both the first and second wedges W1 and W2 have a generally triangular shape, as shown in FIG. 5C. The first wedge W1 has a first side that extends from a tip 550 of the bolt body 501 towards a first interface point 555, such that the first side is generally oriented toward the proximal end 509 of the firearm bolt assembly 500. A second side of the first wedge W1 extends along a line that extends perpendicularly (relative to axis A) from the first interface point 555 along the top surface of the firearm bolt body 501 towards an edge point 557 on an edge of track slot 520' in bolt body 501. The second side may have a linear component that transitions to a curvilinear component as the line approaches the edge point 557. The third side of the first wedge W1 extends along a line from the tip 550 to a point intersecting the line defining the second side of wedge W1, such that wedge W1 is in the form of a right triangle. The first interface point 555 may be understood as the point at which the first side (e.g., the hypotenuse) of the wedge W1 meets a shoulder 558 of bolt body 501. Cam surface 517 is defined generally along the first side of the first wedge W1.

The second wedge W2 has a first side that extends from a tip 560 of the bolt head 503 towards a second interface point 565 along an edge 569 of track slot 520', such that the first side of W2 is generally oriented towards the distal end 511 of the firearm bolt assembly 500. The second interface point 565 may be understood as the point at which the first side (e.g., the hypotenuse) of the wedge W2 meets the edge of track slot 520'. A second side of the second wedge W2 extends along a line that extends perpendicularly (relative to axis A) from the second interface point 565 along the top surface of the firearm bolt head 503 towards an edge point 567 on an edge of track slot 520 in bolt head 503. The second side of wedge W2 may have a curvilinear component proximate the edge point 565 that transitions to a linear component as it extends perpendicular to the axis A and away from the edge point 565. In embodiments the edge point 567 is substantially opposite the edge point 559. The third side of the second wedge W2 extends along a line from the tip 560 to a point intersecting the line defining the second side of wedge W2, such that wedge W2 is in the form of a right triangle. Cam surface 513 is defined generally along the first side of the second wedge W2.

In contrast and with reference to FIG. 5D, the second cam system of the present disclosure may be understood to be defined by first and second inverse wedges, IW1 and IW2, wherein the first inverse wedge IW1 is defined by the bolt body 502, and the second inverse wedge IW2 is defined by the bolt head 503. Each of the first and second inverse wedges IW1, IW2 define a generally triangular shape recess, as shown in FIG. 5D. The recess of the first inverse wedge IW1 has a first side that extends from a tip 570 of the bolt body 501 towards a third interface point 575, such that the first side is generally oriented towards the distal end 511. A second side of the first inverse wedge IW1 extends along a shoulder 578 of bolt body 501. The third side of the first inverse wedge IW1 extends along a line from the tip 570 to a point intersecting the line defining the second side of inverse wedge IW1, such that inverse wedge IW1 is in the form of a right triangle. The third interface point 575 may be understood as the point at which the first side (e.g., the hypotenuse) of the first inverse wedge IW1 meets shoulder 578. Cam surface 519 is defined generally along the first side (e.g., the hypotenuse) of the first inverse wedge IW1.

The second inverse wedge IW2 has a first side that extends from a tip 580 of the bolt head 503 towards a fourth interface point 585, such that the first side of IW2 is generally oriented toward the proximal end 509. The fourth interface point 585 may be understood as the point at which the first side (e.g., the hypotenuse) of the second inverse wedge IW2 meets a shoulder 588 of the bolt head 503. A second side of the second inverse wedge IW2 extends along a line that extends perpendicularly (relative to axis A) from the fourth interface point 585 along the shoulder 588 towards track slot 520 in bolt head 503. The third side of the second inverse wedge IW2 extends along a line from the tip 580 to a point intersecting the line defining the second side of inverse wedge IW2, such that inverse wedge IW2 is in the form of a right triangle. Cam surface 513 is defined generally along the first side of the second wedge W2.

Referring again to FIG. 5C, the first and second wedges W1, W2 may define respective first and second necks. The first neck (of wedge W1) extends for a distance D2 and is the narrowest surface distance between the first interface point 555 and a point on an edge of track slot 520' on firearm bolt body 501 (e.g., first edge point 557). The second neck (of wedge W2) extends for a distance D3 and is the narrowest surface distance between the second interface point 565 and a point on an edge of track slot 520 on firearm bolt head 503 (e.g., second edge point 567)

Similarly, and with reference to FIG. 5D, the first and second inverse wedges IW1, IW2, may define third and fourth necks. The third neck (of inverse wedge IW1) extends for a distance D4 and is the shortest surface distance between the third interface point 577 and a point on an edge of track slot 520' in bolt body 501 (e.g., third edge point 577). The fourth neck (of inverse wedge IW2) extends for a distance D5 and is the shortest surface distance between the fourth interface point 585 and a point on an edge of track slot 520 in bolt head 503 (e.g., fourth edge point 587). In embodiments, distances D2 and D3 are greater than distances D4 and D5, allowing the first and second wedges W1, W2 to withstand greater compressive forces than the first and second inverse wedges.

As further shown in FIG. 5C, the cam surfaces defined by the first and second wedges W1, W2 are configured such that they compress against one another as force is applied to firearm bolt body 501 towards the proximal end 509, e.g., to transition the firearm bolt assembly 500 from the initial position to the firing position. In contrast and as shown in FIG. 5D, the first inverse wedge IW1 is configured to nest within a recess defined by the second inverse wedge IW2, and the second inverse wedge IW2 is configured to nest within a recess defined by the first inverse wedge IW1. Consequently, the cam surfaces defined by the first and second inverse wedges IW, IW2 are configured to compress against one another as force is applied to firearm bolt body 501 towards the distal end 511, e.g., to transition the firearm bolt assembly 500 from the firing position to the initial position.

EXAMPLES

Example 1: In this example there is provided a firearm bolt assembly, including: a first side, a second side, a proximal end, and a distal end, the first side being substantially opposite the second side; a bolt head; a bolt body; a first cam system defined by only a pair of single first complementary cam surfaces proximate the first side of the firearm bolt assembly, the bolt head including one of the pair of single first complementary cam surfaces, the bolt body including another of the pair of single first complementary cam surfaces; and a second cam system defined by only a pair of single second complementary cam surfaces proximate the second side of the firearm bolt assembly, the bolt head including one of the pair of single second complementary cam surfaces, the bolt body including another of the pair of single second complementary cam surfaces.

Example 2: This example includes any or all of the features of example 1, wherein: the firearm bolt assembly is movable from an initial position to a firing position by compression of the bolt body towards the proximal end, during which a predominant compression force is born by the first cam system; and the firearm bolt assembly is movable from the firing position to the initial position by retraction of the bolt body away from the proximal end, during which a predominant compression force is born by the second cam system.

Example 3: This example includes any or all of the features of example 1, wherein: one of the pair of single first complementary cam surfaces includes a first helical cam surface and the other of the pair of single first complementary cam surfaces includes second helical cam surface that is complementary to the first helical cam surface, such that when the firearm bolt assembly is moved from the initial position to the firing position interaction of the first and second helical cam surfaces causes the bolt head to twist, relative to the bolt body, in a first direction about an axis extending through the bolt head and the bolt body.

Example 4: This example includes any or all of the features of example 3, wherein: one of the pair of single second complementary cam surfaces includes a third helical cam surface and the other of the pair of single second complementary cam surfaces includes a fourth helical cam surface complementary to the third helical cam surface, such that when the firearm bolt assembly is moved from the firing position to the initial position, interaction of the third and fourth helical cam surfaces causes the bolt head to twist, relative to the bolt body, in a second direction about the axis extending through the bolt head and the bolt body, the second direction being substantially opposite the first direction.

Example 5: This example includes any or all the features of example 2, wherein when the firearm bolt assembly is moved from the initial position to the firing position, the predominant compressive force is directed towards the proximal end.

Example 6: This example includes any or all the features of example 2, wherein when the firearm bolt assembly is moved from the firing position to the initial position, the predominant compressive force is directed towards the distal end.

Example 7: According to this example there is provided a machine gun, including: a rotationally driven rotor; a plurality of barrels, wherein each of the plurality barrels is disposed in the rotor; at least one firearm bolt assembly aligned within a respective one of the plurality of barrels, wherein the at least one firearm bolt assembly includes: a first side, a second side, a proximal end, and a distal end, the first side being substantially opposite the second side; a bolt head; a bolt body; a first cam system defined by only a pair of single first complementary cam surfaces proximate the first side of the firearm bolt assembly, the bolt head including one of the pair of single first complementary cam surfaces, the bolt body including another of the pair of single first complementary cam surfaces; and a second cam system defined by only a pair of single second complementary cam surfaces proximate the second side of the firearm bolt assembly, the bolt head including one of the pair of single second complementary cam surfaces, the bolt body including another of the pair of single second complementary cam surfaces.

Example 8: This example includes any or all of the features of example 7, wherein: the firearm bolt assembly is movable from an initial position to a firing position by compression of the bolt body towards the proximal end, during which a predominant compression force is born by the first cam system; and the firearm bolt assembly is movable from the firing position to the initial position by retraction of the bolt body away from the proximal end, during which a predominant compression force is born by the second cam system.

Example 9: This example includes any or all of the features of example 7, wherein: one of the pair of single first complementary cam surfaces includes a first helical cam surface and the other of the pair of single first complementary cam surfaces includes second helical cam surface that is complementary to the first helical cam surface, such that when the firearm bolt assembly is moved from the initial position to the firing position interaction of the first and second helical cam surfaces causes the bolt head to twist, relative to the bolt body, in a first direction about an axis extending through the bolt head and the bolt body.

Example 10: This example includes any or all of the features of example 7, wherein: one of the pair of single second complementary cam surfaces includes a third helical cam surface and the other of the pair of single second complementary cam surfaces includes a fourth helical cam surface complementary to the third helical cam surface, such that when the firearm bolt assembly is moved from the firing position to the initial position, interaction of the third and fourth helical cam surfaces causes the bolt head to twist, relative to the bolt body, in a second direction about the axis extending through the bolt head and the bolt body, the second direction being substantially opposite the first direction.

Example 11: This example includes any or all the features of example 8, wherein when the firearm bolt assembly is moved from the initial position to the firing position, the predominant compressive force is directed towards the proximal end.

Example 12: This example includes any or all the features of example 8, wherein when the firearm bolt assembly is moved from the firing position to the initial position, the predominant compressive force is directed towards the distal end.

Example 13: According to this example there is provided a firearm bolt assembly that is movable between an initial position and a firing position, including: a first side, a second side, a proximal end, and a distal end, the first side being substantially opposite the second side; a bolt body including a first wedge proximate the first side of the firearm bolt assembly and a first inverse wedge proximate the second side of the firearm bolt assembly; a bolt head including a second wedge proximate the first side of the firearm bolt assembly and a second inverse wedge proximate the second side of the firearm bolt assembly; wherein: the first and second wedges define a first cam system, the first cam system including a first cam surface on the first wedge that is oriented towards the proximal end of the firearm bolt assembly, and a second cam surface on the second wedge that is oriented towards the distal end of the firearm assembly; and the first and second inverse wedges define a second cam system, the second cam system including a third cam surface on the first inverse wedge that is oriented towards the distal end of the firearm bolt assembly, and a fourth cam surface of the second inverse wedge that is oriented towards the proximate end of the firearm bolt assembly.

Example 14: This example includes any or all of the features of example 13, wherein: the firearm bolt assembly is movable from an initial position to a firing position by compression of the bolt body towards the proximal end, during which a predominant compression force is born by the first cam system; and the firearm bolt assembly is movable from the firing position to the initial position by retraction of the bolt body away from the proximal end, during which a predominant compression force is born by the second cam system.

Example 15: This example includes any or all of the features of example 14, wherein: the first cam surface is a first helical cam surface and the second cam surface is a second helical cam surface that is complementary to the first helical cam surface; the third cam surface is a third helical cam surface and the fourth cam surface is a fourth helical cam surface that is complementary to the third helical cam surface, the third and fourth helical cam surfaces being substantial opposites of the first and second helical cam surfaces, respectively.

Example 16: This example includes any or all of the features of example 14, wherein when the firearm bolt assembly is moved from the initial position to the firing position, the first and second helical cam surfaces interact and cause the bolt head to twist, relative to the bolt body, in a first direction about an axis extending through the bolt head and the bolt body.

Example 17: This example includes any or all of the features of example 16, wherein when the firearm bolt assembly is moved from the firing position to the initial position the third and fourth helical cam surfaces interact and cause the bolt head to twist, relative to the bolt body, in a second direction about the axis extending through the bolt head and the bolt body, the second direction being substantially opposite the first direction.

Example 18: This example includes any or all the features of example 14, wherein when the firearm bolt assembly is moved from the initial position to the firing position, the predominant compressive force is directed towards the proximal end.

Example 19: This example includes any or all the features of example 14, wherein when the firearm bolt assembly is moved from the firing position to the initial position, the predominant compressive force is directed towards the distal end.

As may be appreciated from the foregoing, the firearm bolt assemblies described herein may be configured to localize compressive forces applied during a transition from an initial position to a firing position to a first cam system on one side of the firearm bolt assembly, and to localize compressive forces applied during a transition from the firing position to the initial position to a second cam system another side of the firearm bolt assembly. Localizing the forces in that manner enables the use of a first cam system that is relatively robust compared to the second cam system. Such designs may exhibit improved durability relative to the GE and Dillon bolts of the prior art.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed is:

1. A firearm bolt assembly, comprising:

a first side, a second side, a proximal end, and a distal end, the first side being substantially opposite the second side;

a bolt head;

a bolt body;

a first cam system defined by only a pair of single first complementary cam surfaces proximate the first side of the firearm bolt assembly, the bolt head comprising one of the pair of single first complementary cam surfaces, the bolt body comprising another of the pair of single first complementary cam surfaces; and a second cam system defined by only a pair of single second complementary cam surfaces proximate the second side of the firearm bolt assembly, the bolt head comprising one of the pair of single second complementary cam surfaces, the bolt body comprising another of the pair of single second complementary cam surfaces.

2. The firearm bolt assembly of claim 1, wherein:

the firearm bolt assembly is configured such that it is movable from an initial position to a firing position by compression of the bolt body towards the proximal end, during which a predominant compression force is born by the first cam system; and the firearm bolt assembly is configured such that it is movable from the firing position to the initial position by retraction of the bolt body away from the proximal end, during which a predominant compression force is born by the second cam system.

3. The firearm bolt assembly of claim 1, wherein:

one of the pair of single first complementary cam surfaces comprises a first helical cam surface and the other of the pair of single first complementary cam surfaces comprises second helical cam surface that is complementary to the first helical cam surface, configured such that when the firearm bolt assembly is moved from the initial position to the firing position interaction of the first and second helical cam surfaces causes the bolt head to twist, relative to the bolt body, in a first direction about an axis extending through the bolt head and the bolt body.

4. The firearm bolt assembly of claim 3, wherein:

one of the pair of single second complementary cam surfaces comprises a third helical cam surface and the other of the pair of single second complementary cam surfaces comprises a fourth helical cam surface complementary to the third helical cam surface, configured such that when the firearm bolt assembly is moved from the firing position to the initial position, interaction of the third and fourth helical cam surfaces causes the bolt head to twist, relative to the bolt body, in a second direction about the axis extending through the bolt head and the bolt body, the second direction being substantially opposite the first direction.

5. The firearm bolt assembly of claim 2, wherein the firearm bolt assembly is configured such that when it is moved from the initial position to the firing position, the predominant compressive force is directed towards the proximal end.

6. The firearm bolt assembly of claim 2, wherein the firearm bolt assembly is configured such that when it is moved from the firing position to the initial position, the predominant compressive force is directed towards the distal end.

7. A machine gun, comprising:

a rotationally driven rotor;

a plurality of barrels, wherein each of said plurality barrels is disposed in the rotor;

at least one firearm bolt assembly aligned within a respective one of the plurality of barrels, wherein the at least one firearm bolt assembly comprises:

a first side, a second side, a proximal end, and a distal end, the first side being substantially opposite the second side;

a bolt head;

a bolt body;

a first cam system defined by only a pair of single first complementary cam surfaces proximate the first side of the firearm bolt assembly, the bolt head comprising one of the pair of single first complementary cam surfaces, the bolt body comprising another of the pair of single first complementary cam surfaces; and a second cam system defined by only a pair of single second complementary cam surfaces proximate the second side of the firearm bolt assembly, the bolt head comprising one of the pair of single second complementary cam surfaces, the bolt body comprising another of the pair of single second complementary cam surfaces.

8. The machine gun of claim 7, wherein:

the firearm bolt assembly is configured to be movable from an initial position to a firing position by compression of the bolt body towards the proximal end, during which a predominant compression force is born by the first cam system; and the firearm bolt assembly is configured to be movable from the firing position to the initial position by retraction of the bolt body away from the proximal end, during which a predominant compression force is born by the second cam system.

9. The machine gun of claim 7, wherein:

one of the pair of single first complementary cam surfaces comprises a first helical cam surface and the other of the pair of single first complementary cam surfaces comprises second helical cam surface that is complementary to the first helical cam surface, configured such that when the firearm bolt assembly is moved from the initial position to the firing position interaction of the first and second helical cam surfaces causes the bolt head to twist, relative to the bolt body, in a first direction about an axis extending through the bolt head and the bolt body.

10. The machine gun of claim 7, wherein:

one of the pair of single second complementary cam surfaces comprises a third helical cam surface and the other of the pair of single second complementary cam surfaces comprises a fourth helical cam surface complementary to the third helical cam surface, configured such that when the firearm bolt assembly is moved from the firing position to the initial position, interaction of the third and fourth helical cam surfaces causes the bolt head to twist, relative to the bolt body, in a second direction about the axis extending through the bolt head and the bolt body, the second direction being substantially opposite the first direction.

11. The machine gun of claim 8, wherein the firearm bolt assembly is configured such that when the firearm bolt assembly is moved from the initial position to the firing position, the predominant compressive force is directed towards the proximal end.

12. The machine gun of claim 8, wherein the firearm bolt assembly is configured such that when the firearm bolt assembly is moved from the firing position to the initial position, the predominant compressive force is directed towards the distal end.

13. A firearm bolt assembly configured to be movable between an initial position and a firing position, comprising:

a first side, a second side, a proximal end, and a distal end, the first side being substantially opposite the second side;

a bolt body comprising a first wedge proximate the first side of the firearm bolt assembly and a first inverse wedge proximate the second side of the firearm bolt assembly;

a bolt head comprising a second wedge proximate the first side of the firearm bolt assembly and a second inverse wedge proximate the second side of the firearm bolt assembly; wherein:

the first and second wedges define a first cam system, the first cam system comprising a first cam surface on the first wedge that is oriented towards the proximal end of the firearm bolt assembly, and a second cam surface on the second wedge that is oriented towards the distal end of the firearm assembly; and the first and second inverse wedges define a second cam system, the second cam system comprising a third cam surface on the first inverse wedge that is oriented towards the distal end of the firearm bolt assembly, and a fourth cam surface of the second inverse wedge that is oriented towards the proximate end of the firearm bolt assembly.

14. The firearm bolt assembly of claim 13, wherein:

the firearm bolt assembly is configured to be movable from an initial position to a firing position by compression of the bolt body towards the proximal end, during which a predominant compression force is born by the first cam system; and the firearm bolt assembly is configured to be movable from the firing position to the initial position by retraction of the bolt body away from the proximal end, during which a predominant compression force is born by the second cam system.

15. The firearm bolt assembly of claim 14, wherein:

the first cam surface is a first helical cam surface and the second cam surface is a second helical cam surface that is complementary to the first helical cam surface;

the third cam surface is a third helical cam surface and the fourth cam surface is a fourth helical cam surface that is complementary to the third helical cam surface, the third and fourth helical cam surfaces being substantial opposites of the first and second helical cam surfaces, respectively.

16. The firearm bolt assembly of claim 14, wherein the firearm bolt assembly is configured such that when the firearm bolt assembly is moved from the initial position to the firing position, the first and second helical cam surfaces interact and cause the bolt head to twist, relative to the bolt body, in a first direction about an axis extending through the bolt head and the bolt body.

17. The firearm bolt assembly of claim 16, wherein the firearm bolt assembly is configured such that when the firearm bolt assembly is moved from the firing position to the initial position the third and fourth helical cam surfaces interact and cause the bolt head to twist, relative to the bolt body, in a second direction about the axis extending through the bolt head and the bolt body, the second direction being substantially opposite the first direction.

18. The firearm bolt assembly of claim 14, wherein the firearm bolt assembly is configured such that when the firearm bolt assembly is moved from the initial position to the firing position, the predominant compressive force is directed towards the proximal end.

19. The firearm bolt assembly of claim 14, wherein the firearm bolt assembly is configured such that when the firearm bolt assembly is moved from the firing position to the initial position, the predominant compressive force is directed towards the distal end.

20. The firearm bolt assembly of claim 13, wherein the first wedge and the second wedge comprise a first neck having a width of D2 and a third neck having a width of D3, respectively;

wherein the first inverse wedge and second inverse wedge comprise a second neck having a width of D4 and a fourth neck having a width of D5, respectively and;

wherein D2>D4 and D3>D5.

* * * * *